US011402769B2

(12) United States Patent
Ikegami et al.

(10) Patent No.: US 11,402,769 B2
(45) Date of Patent: Aug. 2, 2022

(54) IMAGE FORMING APPARATUS AND CONTROL METHOD THEREFOR

(71) Applicant: Brother Kogyo Kabushiki Kaisha, Nagoya (JP)

(72) Inventors: Yusuke Ikegami, Nagoya (JP); Shintaro Sakaguchi, Nagoya (JP); Kotaro Haruta, Yokkaichi (JP); Yuwen Wang, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/351,499

(22) Filed: Jun. 18, 2021

(65) Prior Publication Data

US 2022/0066354 A1 Mar. 3, 2022

(30) Foreign Application Priority Data

Aug. 25, 2020 (JP) ..... JP2020-141423
Oct. 9, 2020 (JP) ..... JP2020-171055

(51) Int. Cl.
*G03G 15/00* (2006.01)
*G03G 15/08* (2006.01)
*G03G 21/18* (2006.01)

(52) U.S. Cl.
CPC ..... *G03G 15/0889* (2013.01); *G03G 15/0863* (2013.01); *G03G 15/0868* (2013.01); *G03G 15/757* (2013.01); *G03G 21/1864* (2013.01)

(58) Field of Classification Search
CPC ..... G03G 15/0863; G03G 15/0865; G03G 15/0868; G03G 15/0889; G03G 15/0891; G03G 15/757; G03G 21/1633; G03G 21/1864; G03G 21/1676
See application file for complete search history.

(56) References Cited

U.S. PATENT DOCUMENTS

2013/0051811 A1* 2/2013 Kawashima ..... G03G 21/1857 399/12
2016/0091858 A1* 3/2016 Shiraki ..... G03G 21/1676 399/12

FOREIGN PATENT DOCUMENTS

JP 2003-186369 A 7/2003

* cited by examiner

*Primary Examiner* — Hoang X Ngo
(74) *Attorney, Agent, or Firm* — Burr & Brown, PLLC

(57) ABSTRACT

An image forming apparatus includes a housing having an opening, a cover configured to openably close the opening, photosensitive drums, cartridges, a first motor and a controller. Each cartridge has a developing roller, a storage chamber configured to store toner, and an agitator configured to agitate the toner. The first motor is configured to rotate the agitators. The controller rotates the agitators by rotating the first motor when forming an image on a sheet. The controller determines whether a new cartridge is included in the plurality of cartridges in response to the image forming apparatus being turned on or in response to the cover being closed. In a case where a new cartridge is included, the controller stirs toner with the agitators by rotating the first motor. In a case where a new cartridge is not included, the controller does not stir the toner.

16 Claims, 17 Drawing Sheets

DEVELOPING ROLLER
SEPARATED
CONTACTING
THIRD MOTOR
ON
OFF
SECOND MOTOR
ON
OFF
FIRST MOTOR
FORWARD ROTATION
STOP
BACKWARD ROTATION
first speed
second speed
first speed
first speed
first speed
T1
T2
YMC CLUTCH
ON
OFF
SEPARATION SENSOR
ON
OFF
FUSER HEATER
ON
OFF
t2 t3
t6
t7
t8 t10 t12 t14 t16 t20
t9 t11 t13 t15
t21 t30
t31
t33 t35
t34
time DEVELOPING ROLLER
SEPARATED
CONTACTING
THIRD MOTOR
ON
OFF
SECOND MOTOR
ON
OFF
FIRST MOTOR
FORWARD ROTATION
STOP
BACKWARD ROTATION
first speed
first speed
first speed
first speed
T1
T2
YMC CLUTCH
ON
OFF
SEPARATION SENSOR
ON
OFF
FUSER HEATER
ON
OFF
t2 t3 t6 t7 t8 t9 t10 t11 t12 t13 t14 t15 t16 t30 t31 t33 t34 t35
time DEVELOPING ROLLER
SEPARATED
CONTACTING
THIRD MOTOR
ON
OFF
SECOND MOTOR
ON
OFF
FIRST MOTOR
FORWARD ROTATION
STOP
BACKWARD ROTATION
YMC CLUTCH
ON
OFF
SEPARATION SENSOR
ON
OFF
FUSER HEATER
ON
OFF
first speed
second speed
second speed
second speed
second speed
T1
T2
t2 t3
t6
t7
t8 t10 t12 t14 t16 t20
t9 t11 t13 t15
t21 t30
t31
t33 t35
t34
time DEVELOPING ROLLER
SEPARATED
CONTACTING
THIRD MOTOR
ON
OFF
SECOND MOTOR
ON
OFF
FIRST MOTOR
FORWARD ROTATION
STOP
BACKWARD ROTATION
first speed
second speed
second speed
second speed
T1
T2
YMC CLUTCH
ON
OFF
SEPARATION SENSOR
ON
OFF
FUSER HEATER
ON
OFF
t2 t3 t6 t7 t8 t9 t10 t11 t12 t13 t14 t15 t16 t30 t31 t33 t34 t35
time

IMAGE FORMING APPARATUS AND CONTROL METHOD THEREFOR

CROSS-REFERENCE TO RELATED APPLICATION

This application claims priority under 35 U.S.C. § 119 from Japanese Patent Application No. 2020-141423 filed on Aug. 25, 2020 and Japanese Patent Application No. 2020-171055 filed on Oct. 9, 2020. The entire subject matter of the applications are incorporated herein by reference.

BACKGROUND

Technical Field

Aspects of the present disclosure relate to an image forming apparatus and a control method therefor.

Related Art

In an electrophotographic image forming apparatus, an initialization operation is performed by rotating motors for a particular period of time in response to the apparatus being turned on or in response to a cover being opened and closed. There has been known an image forming apparatus that performs an initialization operation by rotating motors at low speeds when a new cartridge is mounted.

SUMMARY

If toner is stored for a long period of time or is subjected to vibration during transportation, fluidity of the toner may decrease and the toner may solidify. When loosening the solidified toner, there is a problem that load for stirring the toner is large. On the other hand, in non-new cartridges, since the toner is often not solidified, if the toner is stirred, the toner deteriorates unnecessarily and power is wasted.

According to aspects of the present disclosure, there is provided an image forming apparatus including a housing having an opening, a cover movable between a closed position for closing the opening and an open position for opening the opening, a plurality of photosensitive drums, a plurality of cartridges, a first motor and a controller. Each cartridge has a developing roller, a storage chamber configured to store toner, and an agitator for configured to agitate the toner. The plurality of cartridges are configured to be mounted to the housing through the opening. The first motor is configured to rotate the agitators. The controller is configured to rotate the agitators by rotating the first motor when forming an image on a sheet. The controller is further configured to executes a determination process of determining whether a new cartridge is included in the plurality of cartridges in response to the image forming apparatus being turned on or in response to the cover being moved from the open position to the closed position. In a case where a new cartridge is included, the controller executes an initial stirring process of stirring toner with the agitators by rotating the first motor. In a case where a new cartridge is not included, the controller does not execute the initial stirring process.

According to aspects of the present disclosure, there is further provided a method of controlling an image forming apparatus including a housing having an opening, a cover movable between a closed position for closing the opening and an open position for opening the opening, a plurality of photosensitive drums, and a plurality of cartridges each having a developing roller, a storage chamber configured to store toner, and an agitator configured to agitate the toner, the plurality of cartridges being configured to be mounted to the housing through the opening. The method includes rotating the agitators when forming an image on a sheet, and in response to the image forming apparatus being turned on or in response to the cover being moved from the open position to the closed position, executing a determination process of determining whether a new cartridge is included in the plurality of cartridges, executing an initial stirring process of stirring toner by rotating the agitator in a case where a new cartridge is included, and not executing the initial stirring process in a case where a new cartridge is not included.

According to aspects of the present disclosure, there is further provided an image forming apparatus including a housing having an opening, a cover movable between a closed position for closing the opening and an open position for opening the opening, a plurality of photosensitive drums, a plurality of cartridges, a first motor, a plurality of separation mechanisms, and a controller. Each cartridge has a developing roller, a storage chamber configured to store toner, and an agitator configured to agitate the toner. the plurality of cartridges are configured to be mounted to the housing through the opening. The first motor is configured to rotate the agitators. Each separation mechanism is configured to move a corresponding developing roller between a contact position at which the developing roller is in contact with the corresponding photosensitive drum and a separated position at which the corresponding developing roller is separated from the photosensitive drum. In response to the image forming apparatus being turned on or in response to the cover being moved from the open position to the closed position, the controller executes an initial separation process of rotating the first motor to move the developing roller of each of the plurality of cartridges to the separated position, executes a determination process of determining whether a new cartridge is included in the plurality of cartridges after executing the initial separation process, executes an initial stirring process of stirring toner with the agitators by rotating the first motor in a case where a new cartridge is included, and does not execute the initial stirring process in a case where a new cartridge is not included.

BRIEF DESCRIPTION OF THE ACCOMPANYING DRAWINGS

DETAILED DESCRIPTION

Figure 1:
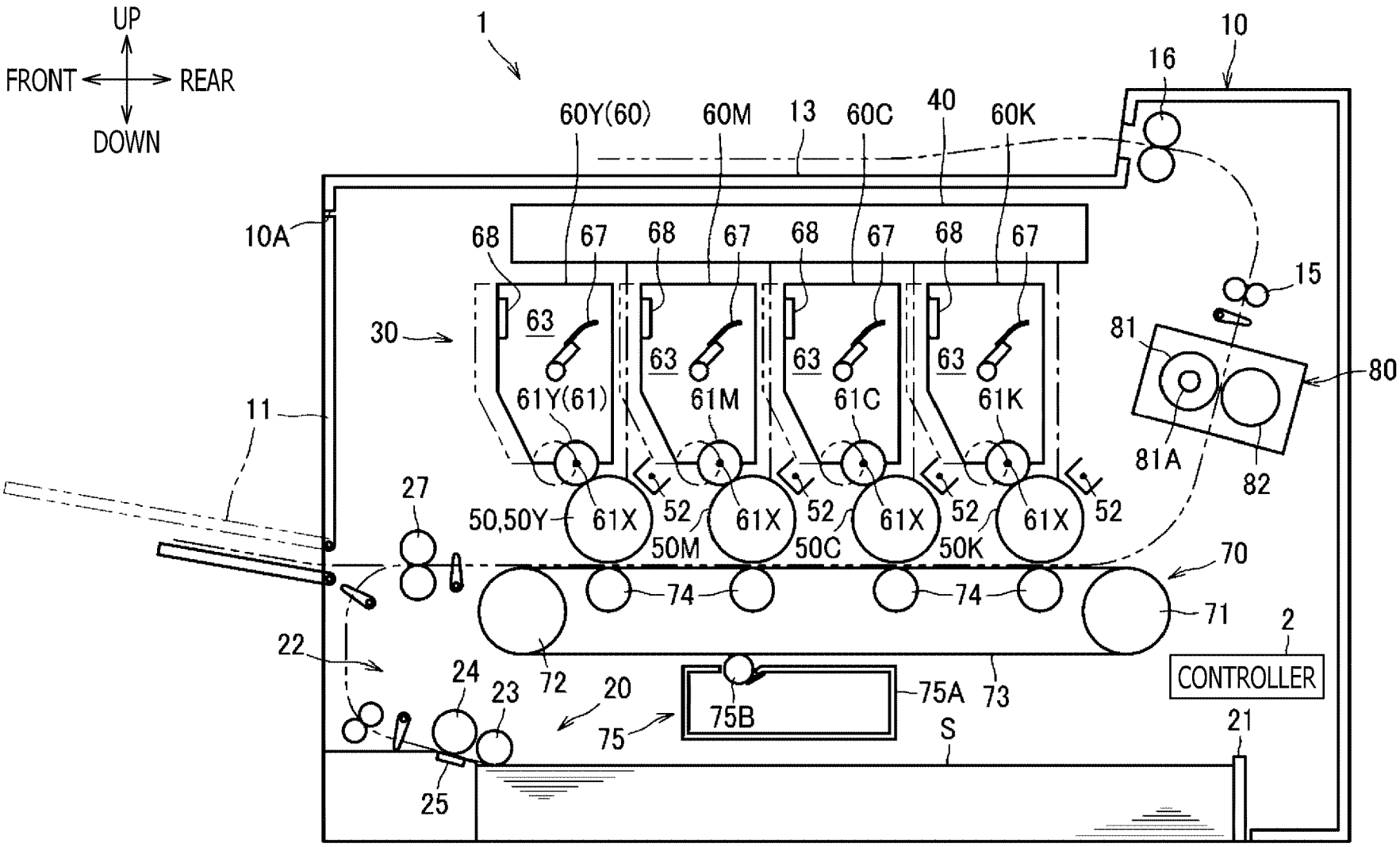
FIG. 1 is a diagram illustrating a schematic configuration of an image forming apparatus according to an embodiment.

As shown in FIG. 1, an image forming apparatus 1 according to an embodiment of the present disclosure is a color printer and mainly includes a housing 10, a cover 11, a sheet feeder 20, an image formation engine 30, and a controller 2. In the present specification, for the sake of convenience, directions such as front and rear will be described assuming that the left side of FIG. 1 from which the sheet tray 21 is drawn out is the front side. That is, in FIG. 1, the left side will be referred to as "front," the right side will be referred to as "rear," the upper and lower sides will be referred to as "up" and "down," the front side of the sheet of FIG. 1 will referred to as "right," and the back side of the sheet of FIG. 1 will be referred to as "left."

The housing 10 has an opening 10A on the front side. The cover 11 is movable between a closed position shown with a solid line for closing the opening 10A and an open position shown with a virtual line for opening the opening 10A. The housing 10 is provided with a conventionally-known cover sensor that detects an open state and a closed state of the cover 11. The controller 2 can determine the open state and the closed state of the cover 11 based on a signal from the cover sensor.

The sheet feeder 20 is provided at a lower portion inside the housing 10 and includes a sheet tray 21 that accommodates sheets S and a feeding mechanism 22 that feeds the sheets S from the sheet tray 21 to the image formation engine 30. The sheet tray 21 is configured to be pulled out of the housing 10 to the left side in FIG. 1 to be detached from the housing 10. The feeding mechanism 22 is provided at a front portion inside the housing 10 and includes a feeding roller 23, a separation roller 24, a separation pad 25 and a registration roller 27. The sheet S in the present disclosure is a medium on which the image forming apparatus 1 can form an image, and includes plain paper, an envelope, a postcard, thin paper, thick paper, glossy paper, a resin sheet, a seal and the like.

In the sheet feeder 20, after the sheets S in the sheet tray 21 are conveyed by the feeding roller 23, the sheets S are separated one by one between the separation roller 24 and the separation pad 25. Thereafter, a leading edge of the sheet S is regulated by the registration roller 27 in a state in which the rotation thereof is stopped, and then the registration roller 27 rotates to feed the sheet S to the image formation engine 30.

The image formation engine 30 includes an exposure device 40, a drawer 90 (see FIG. 2) having a plurality of photosensitive drums 50, a plurality of developing cartridges 60, a conveyer 70 and a fuser 80.

The exposure device 40 includes a conventionally-known laser diode, deflector, lens and mirror. The exposure device 40 is configured to emit a plurality of laser beams to expose the plurality of photosensitive drums 50 to scan surfaces of the photosensitive drums 50.

The plurality of photosensitive drums 50 include a photosensitive drum 50Y corresponding to yellow, a photosensitive drum 50M corresponding to magenta, a photosensitive drum 50C corresponding to cyan, and a photosensitive drum 50 K corresponding to black. In this specification and the drawings, members that are provided to correspond to yellow, magenta, cyan, and black are denoted with Y, M, C, and K, respectively, when distinguishing the colors.

Each developing cartridge 60 includes a developing roller 61 that supplies toner to the photosensitive drum 50. Specifically, the developing cartridges 60Y, 60M, 60C and 60K respectively have the developing rollers 61Y, 61M, 61C and 61K corresponding to the photosensitive drums 50Y, 50M, 50C and 50K for the colors of yellow, magenta, cyan, and black, respectively.

Each developing cartridge 60 includes a case 63 having a storage chamber configured to store toner and an agitator 67 configured to agitate the toner stored in the storage chamber. The developing roller 61 and the agitator 67 of each developing cartridge 60 are connected by a not-shown gear, and when the developing roller 61 rotates, the agitator 67 also rotates simultaneously. Each developing cartridge 60 also includes a memory 68 on a side wall at the front. Identification data indicating whether the developing cartridge 60 is new is stored in the memory 68.

The developing rollers 61Y, 61M, 61C and 61K are arranged in this order from an upstream side toward a downstream side in a moving direction of the sheet S.

Each developing cartridge 60 is movable between a position indicated with a solid line in FIG. 1 and a position indicated with an imaginary line in FIG. 1. When the developing cartridge 60 is at the position indicated with the solid line, the corresponding developing roller 61 is at a contact position where it is in contact with the corresponding photosensitive drum 50. When the developing cartridge 60 is at the position indicated with the imaginary line, the corresponding developing roller 61 is at a separated position where it is separated from the corresponding photosensitive drum 50.

Figure 2:
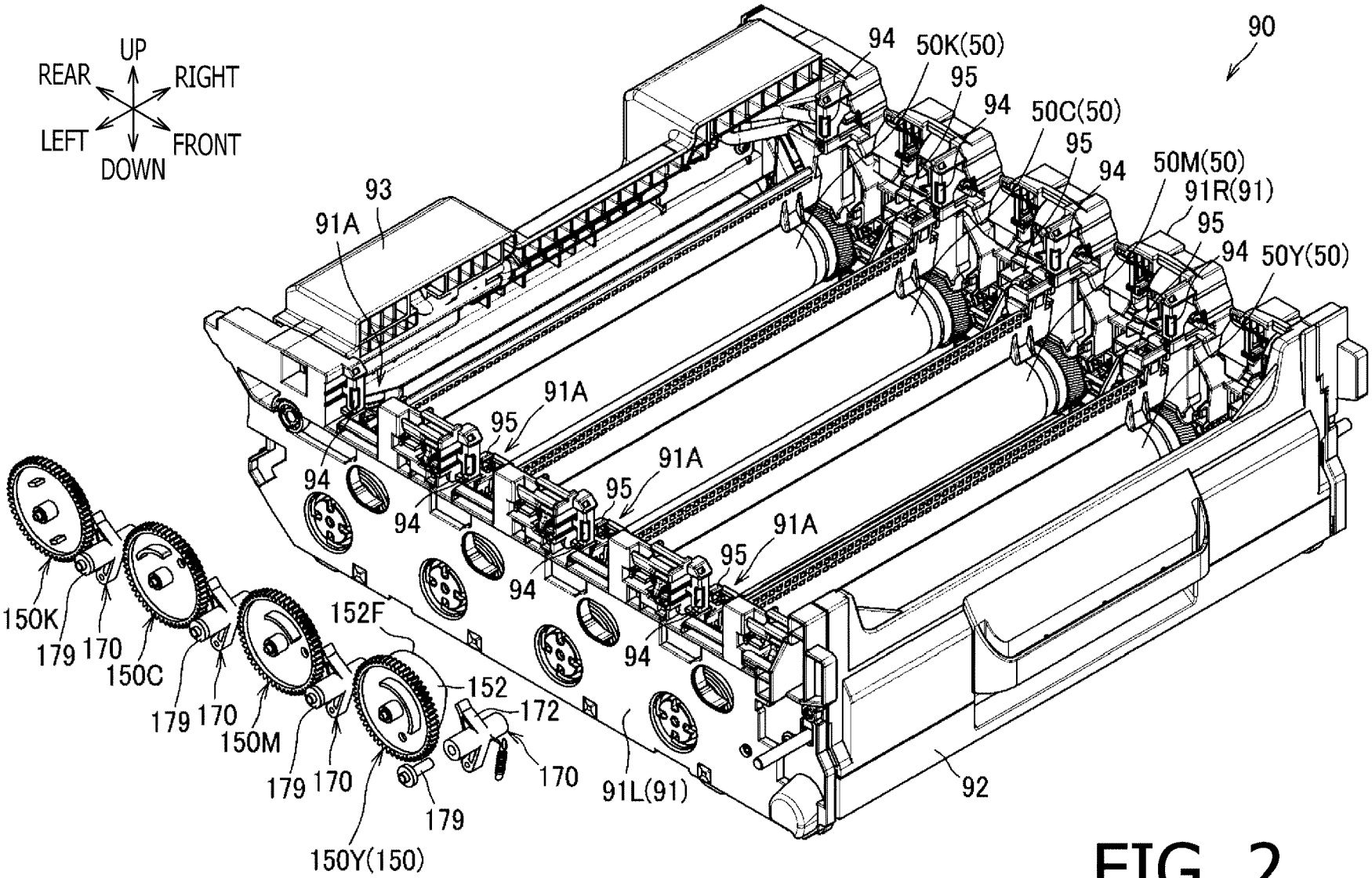
FIG. 2 is a perspective view of a drawer, cams and cam followers.

As shown in FIG. 2, the photosensitive drums 50 are rotatably supported by the drawer 90. The drawer 90 also detachably supports the developing cartridges 60. The drawer 90 is attachable to and detachable from the housing 10 through an opening 10A formed by opening the cover 11 (see FIG. 1) of the housing 10. The drawer 90 includes a pair of side frames 91 disposed apart from each other in an axial direction of the photosensitive drums 50, a coupling frame 92 coupling front portions of the pair of side frames 91 to each other, and a coupling frame 93 coupling rear portions of the pair of side frames 91 to each other. The pair of side frames 91 includes a right side frame 91R and a left side frame 91L. The drawer 90 is provided with chargers 52 (see FIG. 1) that are disposed to face respective photosensitive drums 50 and configured to charge the photosensitive drums 50.

Although the detailed structure is not shown, the pair of side frames 91 supports end portions of the photosensitive drums 50. One side frame 91 (in the present embodiment, the left side frame 91L) has second openings 91A. The second openings 91A are notches that are formed to recess downward at an upper edge of the side frame 91L. The second openings 91A penetrate the left side frame 91L in the left-right direction, and it is made possible for cam followers 170, which will be described later, to enter the second openings 91A.

Further, although not shown, the drawer 90 includes first relay contacts that respectively come into contact with contacts of the memories 68 of the developing cartridges 60 and a second relay contact that is electrically connected to the controller 2 of the main body. The first relay contacts and the second relay contacts are respectively connected by wiring. Thus, the memories 68 can communicate with the controller 2 via respective first relay contacts and second relay contacts.

The image forming apparatus 1 includes a plurality of separation mechanisms each configured to move a corresponding developing roller 61 between a contact position where the developing roller 61 contacts a corresponding photosensitive drum 50 and a separated position where the developing roller 61 is separated from the photosensitive drum 50. The separation mechanisms are provided for yellow, magenta, cyan, and black, respectively.

Specifically, each separation mechanism includes a cam 150 (150Y, 150M, 150C, 150K) that rotates about an axis parallel to a rotation axis 61X (see FIG. 1) of the developing roller 61, a support shaft 179 and a cam follower 170.

The cam 150 has a first cam part 152 protruding in a direction of the rotation axis 61X of the developing roller 61 (hereinafter, simply referred to as a "rotation axis direction").

The support shaft 179 is a shaft extending long in the left-right direction. The support shaft 179 is provided to a not-shown side frame of the housing 10.

The cam follower 170 has a slide shaft part 171 into which the support shaft 179 is inserted. The cam follower 170 is slidable along an axial direction of the support shaft 179 and rotatable about an axis of the support shaft 179 in a state in which the support shaft 179 is inserted into the slide shaft part 171. The cam follower 170 has a contact part 172 that can come into contact with the first cam part 152.

Figure 4A:
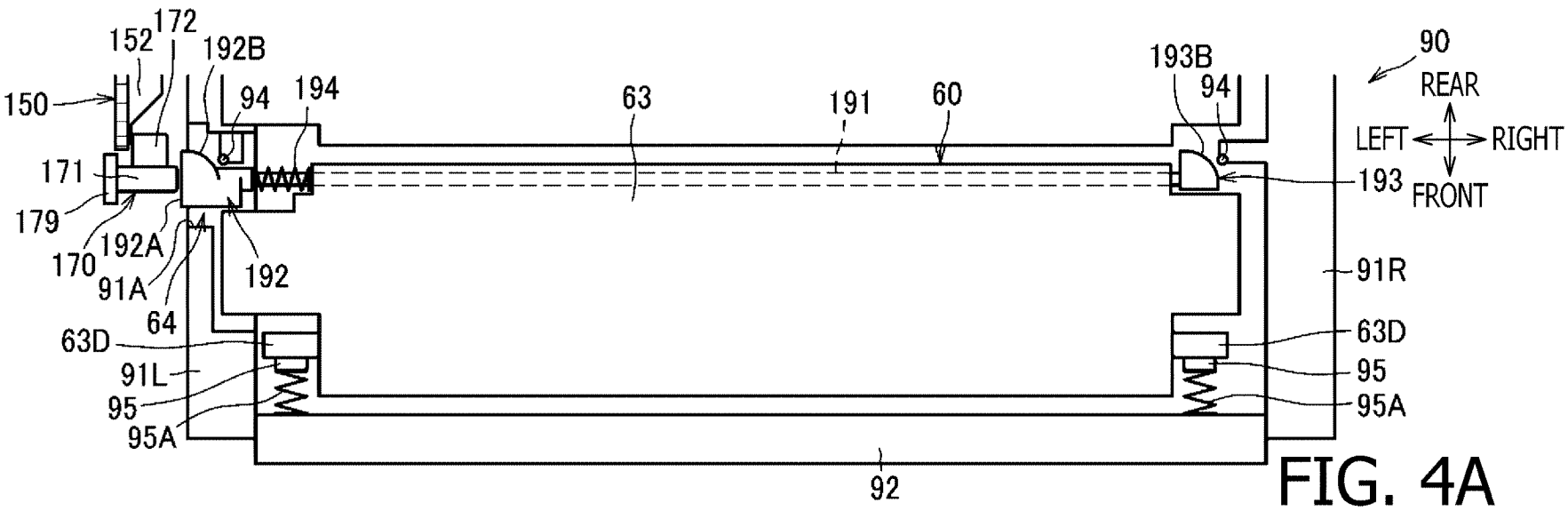
FIG. 4A is a schematic top view of a periphery of the developing cartridge for illustrating a sliding member, and shows a state in which the cam follower is at a standby position.
Figure 4B:
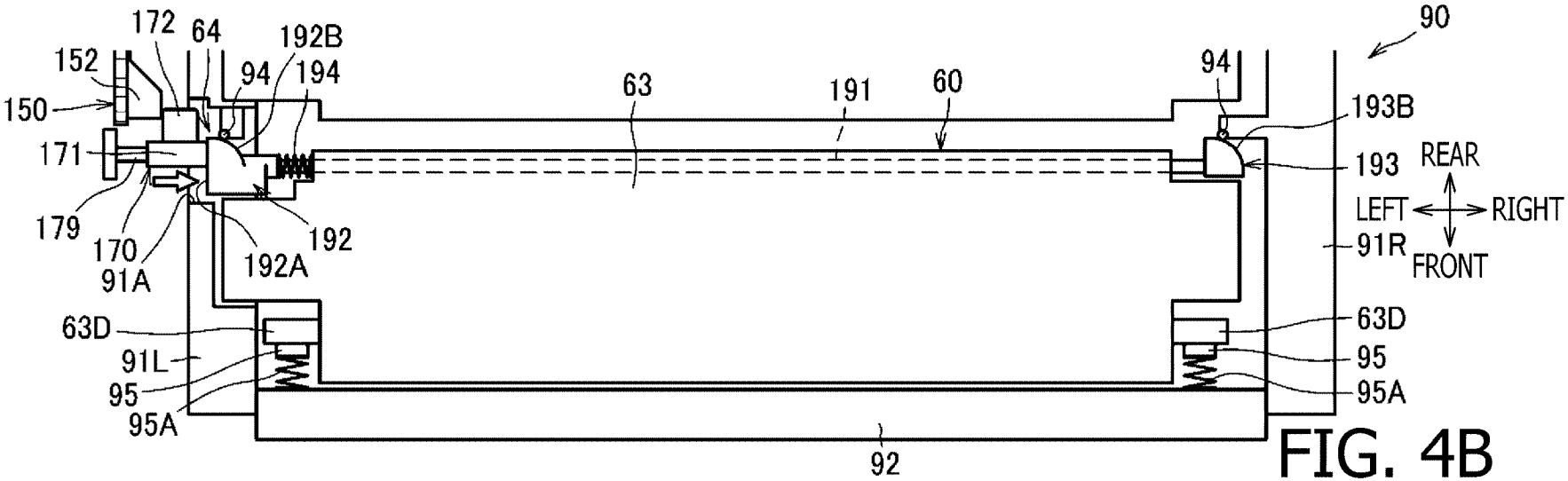
FIG. 4B is a schematic top view of the periphery of the developing cartridge for illustrating the sliding member, and shows a state in which the cam follower is at a protruding position.

Specifically, the cam follower 170 is guided by the first cam part 152 as the cam 150 rotates, and is slidable between a protruding position shown in FIG. 4B for causing the developing roller 61 to be located at the separated position and a standby position shown in FIG. 4B for causing the developing roller 61 to be located at the contact position.

When at the protruding position, the cam follower 170 is in the second opening 91A and presses the developing cartridge 60 to position the developing roller 61 at the separated position, and when at the standby position, the cam follower 170 is outside the second opening 91A to position the developing roller 61 at the contact position.

Referring back to FIG. 2, the cams 150 and the cam followers 170 are provided to respectively correspond to the developing cartridges 60. The cams 150 and the cam followers 170 are disposed on an outer side of the left side frame 91L in the left-right direction. Detailed structures of the cams 150 and the cam followers 170 will be described later.

The drawer 90 is provided with contacted parts 94 that come into contact with slide members 64, which will be described later, at top portions of the side frames 91R and 91L. The contacted part 94 consists of, for example, a roller rotatable about an axis along a third direction (up-down direction) orthogonal to both a first direction parallel to the axial direction of the photosensitive drums 50 and a second direction along which the photosensitive drums 50 are arranged.

Further, the drawer 90 includes pressing members 95 provided to correspond to respective developing cartridges 60. The pressing members 95 are provided at both end portions of the photosensitive drum 50 in the axial direction for each developing cartridge 60. Each pressing member 95 is biased rearward by a spring 95A (see FIGS. 4A and 4B). When the developing cartridge 60 is mounted to the drawer 90, the pressing members 95 press projections 63D of the developing cartridge 60 to bring the developing roller 61 into contact with the corresponding photosensitive drum 50.

Figure 3A:
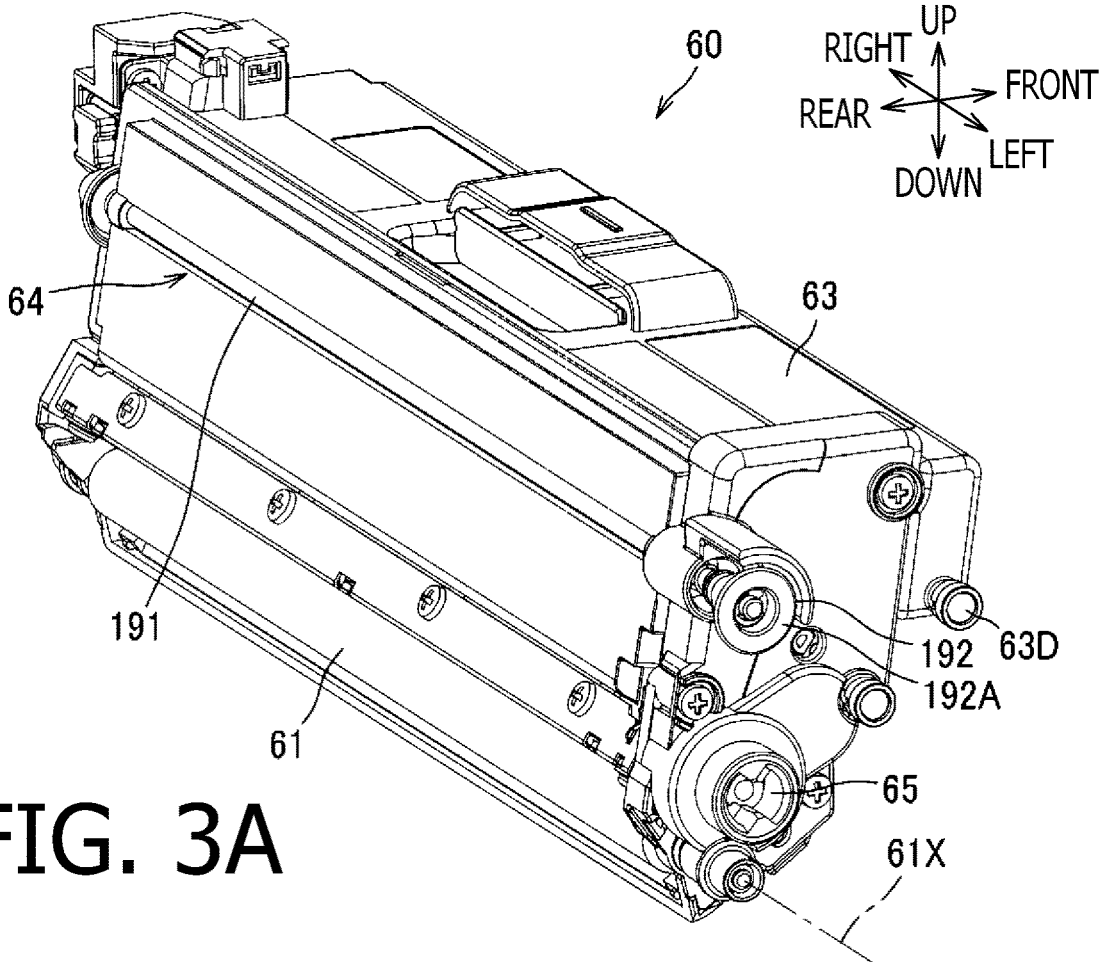
FIG. 3A is a perspective view of a developing cartridge.
Figure 3B:
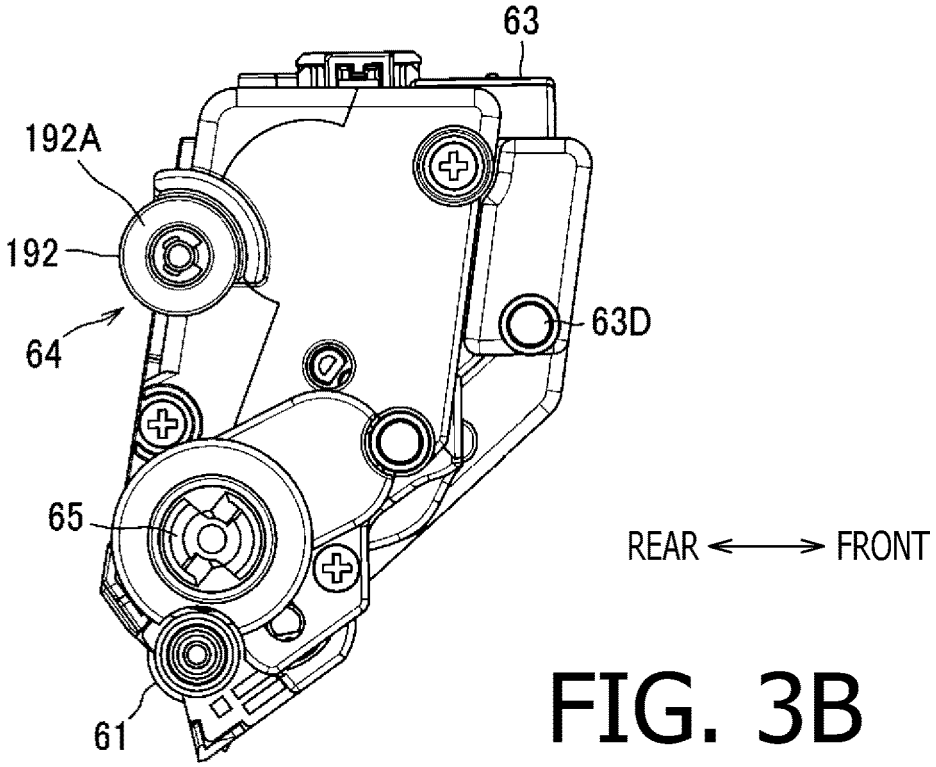
FIG. 3B is a side view of the developing cartridge.

As shown in FIGS. 3A and 3B, the developing cartridge 60 includes the above-described case 63, a slide member 64 and a coupling 65.

The coupling 65 engages with a coupling shaft 119 which will be described later and receives rotational driving force from the coupling shaft 119.

The slide member 64 is a member capable of sliding in the rotation axis direction with respect to the case 63. The slide member 64 is slidable in the rotation axis direction by being pressed by the cam follower 170.

As shown in FIGS. 4A and 4B, the slide member 64 includes a shaft 191, a first contact member 192 and a second contact member 193. The first contact member 192 is fixed to one end of the shaft 191, and the second contact member 193 is fixed to the other end of the shaft 191.

The shaft 191 is disposed to penetrate through a hole formed to the case 63 and extending in the rotation axis direction, and is slidably supported by the case 63.

The first contact member 192 has a pressing surface 192A, which is an end surface in the rotation axis direction, and an inclined surface 192B inclined with respect to the rotation axis direction. The pressing surface 192A is a surface to be pressed by the cam follower 170. When the slide member 64 is pressed in the rotation axis direction by the cam follower 170, the inclined surface 192B comes into contact with the contacted part 94 of the drawer 90 to urge the developing cartridge 60 in a direction parallel to the moving direction of the sheet S, thereby moving the developing cartridge 60 (see FIG. 4B). The inclined surface 192B is inclined such that, the closer the inclined surface 192B is to the other end than to the one end of the shaft 191, the closer the inclined surface 192B gets to the corresponding developing roller 61 in the second direction (i.e., the more the inclined surface 192B is located frontward).

The second contact member 193 has an inclined surface 193B that is inclined in the way similar to the inclined surface 192B of the first contact member 192. When the slide member 64 is pressed in the rotation axis direction by the cam follower 170, the inclined surface 193B also comes into contact with the contacted part 94 of the drawer 90 to urge the developing cartridge 60 in a direction parallel to the moving direction of the sheet S, thereby moving the developing cartridge 60 (see FIG. 4B).

A spring 194 is disposed between the first contact member 192 and the case 63 to bias the slide member 64 toward one side in the rotation axis direction, that is, the left side in the present embodiment. The spring 194 is a compression coil spring and is disposed outside the shaft 191 such that the shaft 191 passes through the coil.

Referring back to FIG. 1, the conveyer 70 is provided between the sheet tray 21 and the photosensitive drums 50. The conveyer 70 includes a driving roller 71, a driven roller 72, a conveying belt 73 formed of an endless belt, and four transfer rollers 74. The conveying belt 73 is wound around the driving roller 71 and the driven roller 72, and an outer surface of the conveying belt 73 is disposed to face each photosensitive drum 50. Each transfer roller 74 is disposed inside the conveying belt 73 so as to nip the conveying belt 73 between the transfer roller 74 and the corresponding photosensitive drum 50. The conveyer 70 conveys the sheet S by moving the conveying belt 73 in a state where the sheet S is placed on an outer peripheral surface on an upper side, and at this time, the toner images on the plurality of photosensitive drums 50 are transferred to the sheet S.

A belt cleaner 75 that cleans the surface of the conveying belt 73 is provided below the conveying belt 73. The belt cleaner 75 includes a case 75A and a cleaning roller 75B. The cleaning roller 75B is in contact with the surface of the conveying belt 73 and removes foreign substances such as toner from the surface of the conveying belt 73. The foreign substances removed by the cleaning roller 75B is accumulated in the case 75A.

Figure 5:
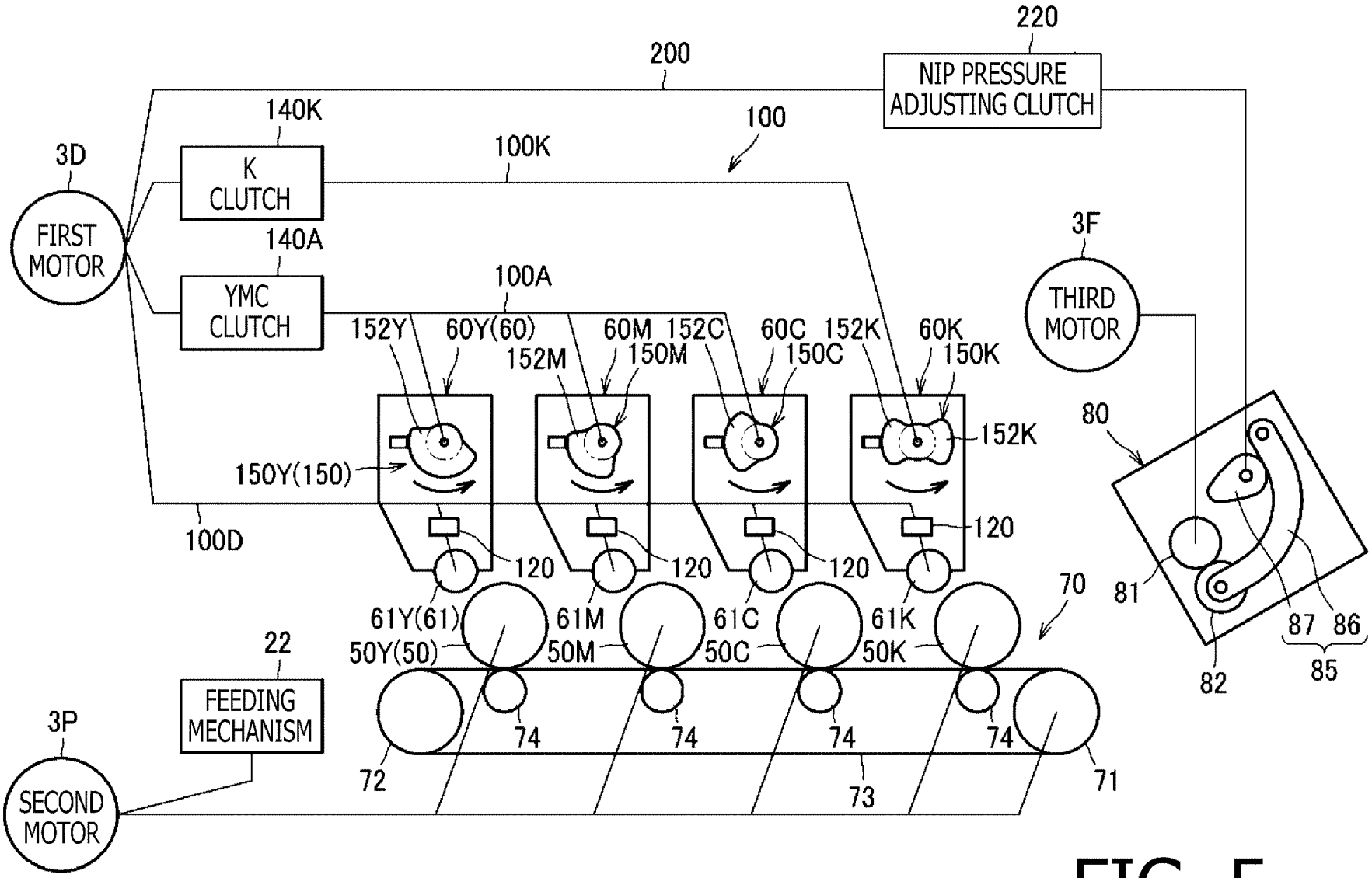
FIG. 5 is a diagram illustrating connections of mechanisms configured to move each member with each motor.

The fuser 80 is provided behind the photosensitive drums 50 and the conveyer 70. The fuser 80 includes a heating roller 81 and a pressing roller 82 disposed to face the heating roller 81. A heater 81A (in the present embodiment, a halogen lamp) configured to heat the heating roller 81 is provided inside the heating roller 81. Temperature of the heating roller 81 can be controlled by controlling output of the heater 81A. As shown in FIG. 5, the fuser 80 includes a nip pressure adjusting mechanism 85. The nip pressure adjusting mechanism 85 includes an arm 86 and a nip pressure adjusting cam 87. As shown in FIG. 5, the pressing roller 82 is supported by the swingable arm 86. The nip pressure adjusting cam 87 rotates to swing the arm 86, thereby changing a distance between axes of the heating roller 81 and the pressing roller 82. Thus, it is possible to adjust nip pressure between the heating roller 81 and the pressing roller 82.

Referring back to FIG. 1, a conveying roller 15 is provided above the fuser 80, and an ejection roller 16 is provided above the conveying roller 15.

In the image formation engine 30 configured as described above, first, the surface of each photosensitive drum 50 is uniformly charged by the charger 52 and then exposed to light emitted from the exposure device 40. Thus, an electrostatic latent image based on image data is formed on each photosensitive drum 50.

The toner in the case 63 is carried by the surface of the developing roller 61, and is supplied to the electrostatic latent image formed on the photosensitive drum 50 when the developing roller 61 faces and contacts the photosensitive drum 50. Thus, a toner image is formed on the photosensitive drum 50.

Next, when the sheet S supplied onto the conveying belt 73 passes between each photosensitive drum 50 and each transfer roller 74, the toner image formed on each photosensitive drum 50 is transferred onto the sheet S. When the sheet S passes between the heating roller 81 and the pressing roller 82, the toner image transferred onto the sheet S is thermally fixed to the sheet S.

The sheet S ejected from the fuser 80 is accumulated on a sheet ejection tray 13 on an upper surface of the housing 10 by the conveying roller 15 and the ejection roller 16.

Now referring to FIG. 5, an outline of a mechanism configure to move the developing rollers 61, the agitators 67, the separation mechanisms including the cams 150, the photosensitive drums 50, and the fuser 80 with motors will be described.

The image forming apparatus 1 includes a first motor 3D, a second motor 3P, a third motor 3F, and a driving force transmission mechanism 100.

The first motor 3D drives the developing rollers 61, the agitators 67, the cams 150 that are parts of the separation mechanisms, and the nip pressure adjusting mechanism 85 of the fuser 80. The first motor 3D can rotate in a first direction and a second direction opposite to the first direction, and the rotation direction and a rotation speed of the first motor 3D are controlled by the controller 2. The first direction is a rotation direction for forming an image. in the present specification, the rotation of the first motor 3D in the first direction is also referred to as "forward rotation." The second direction is an exceptional rotation direction for moving each developing roller 61 to the separated position in response to the image forming apparatus 1 being turned on or in response to the cover 11 being moved from the open position to the closed position. In the present specification, the rotation of the first motor 3D in the second direction is also referred to as "reverse rotation."

The second motor 3P is a motor that rotates the plurality of photosensitive drums 50 and the conveying belt 73 of the conveyer 70 and transmits driving force to the feeding mechanism 22.

The third motor 3F is a motor that rotates the heating roller 81 of the fuser 80.

The driving force transmission mechanism 100 includes a first gear train 100A capable of transmitting driving force of the first motor 3D to the cams 150Y, 150M and 150C, a second gear train 100K capable of transmitting driving force of the first motor 3D to the K cam 150K, and a third gear train 100D capable of transmitting driving force of the first motor 3D to the developing rollers 61. The cam 150Y, the cam 150M and the cam 150C are mechanically connected via gears, and are provided so as to be simultaneously rotationally driven by the driving force of the first motor 3D.

The first gear train 100A includes a YMC clutch 140A. The YMC clutch 140A is an electromagnetic clutch and can be switched between a transmission state for transmitting the driving force of the first motor 3D to the cams 150Y, 150M and 150C and a disconnection state for not transmitting the driving force of the first motor 3D to the cams 150Y, 150M and 150C. The second gear train 100K includes a K clutch 140K. The K clutch 140K is an electromagnetic clutch and can be switched between a transmission state for transmitting the driving force of the first motor 3D to the K cam 150K and a disconnection state for not transmitting the driving force of the first motor 3D to the K cam 150K. It is noted that in FIG. 5, the cams 150 are schematically shown. Hereinafter, the transmission states of the clutches 140A and 140K may also be referred to as "ON," and the disconnection states of the clutches 140A and 140K may also be referred to as "OFF."

The third gear train 100D includes a plurality of mechanical clutches 120, one for each of the plurality of developing rollers 61. As will be described in detail later, the mechanical clutch 120 is configured to transmit the driving force from the first motor 3D to the developing roller 61 at the contact position and not to transmit the driving force from the first motor 3D to the developing roller 61 at the separated position.

The image forming apparatus 1 further includes a fourth gear train 200 capable of transmitting the driving force of the first motor 3D to the nip pressure adjusting cam 87. The fourth gear train 200 includes a nip pressure adjusting clutch 220. The nip pressure adjusting clutch 220 is an electromagnetic clutch and can be switched between a transmission state for transmitting the driving force of the first motor 3D to the nip pressure adjusting cam 87 and a disconnection state for not transmitting the driving force to the nip pressure adjusting cam 87. It is noted that in FIG. 5, the nip pressure adjusting clutch 220 is schematically shown.

Figure 6A:
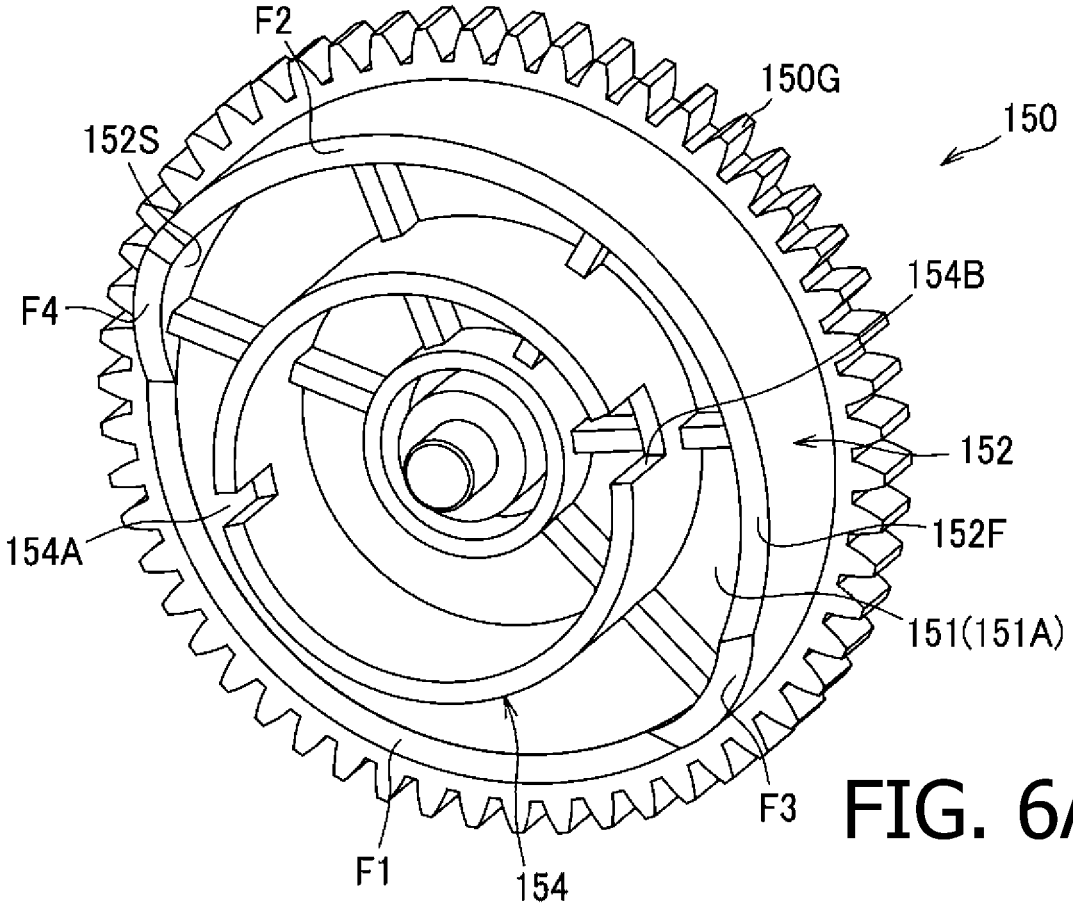
FIG. 6A is a perspective view of the cam for yellow, magenta, and cyan as viewed from a first surface side.
Figure 6B:
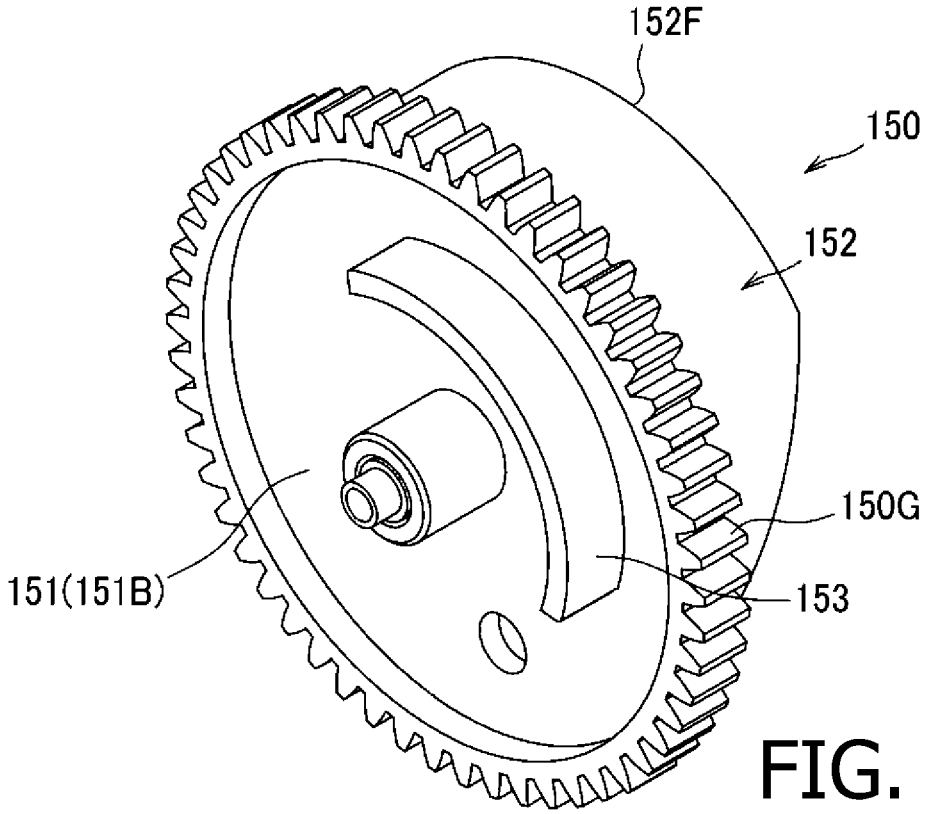
FIG. 6B is a perspective view of the cam for yellow, magenta, and cyan as viewed from a second surface side.

As shown in FIGS. 6A and 6B, the cam 150 includes a disk part 151, a gear part 150G, a first cam part 152, a second cam part 153, and a phase detection wall 154. The cam 150 is a member that rotates to move the corresponding developing roller 61 between the contact position and the separated position.

The disk part 151 has a substantially disk shape and is rotatably supported by the housing 10.

The gear part 150G is formed on an outer periphery of the disk part 151.

The first cam part 152 is an end surface cam for moving the developing roller 61 and is protruding in a rotation axis direction of the cam 150 from a first surface 151A which is one surface of the disk part 151. The first cam part 152 is formed integrally with the disk part 151. The first cam part 152 has a shape extending in a circumferential direction about the rotation axis of the cam 150. The first cam part 152 has a cam surface 152F on an end surface in the rotation axis direction of the cam 150.

The cam surface 152F has a first holding surface F1, a second holding surface F2, a first guide surface F3 and a second guide surface F4. The first holding surface F1 holds the cam follower 170 at the standby position. The second holding surface F2 holds the cam follower 170 at the protruding position. The first guide surface F3 is a surface connecting the first holding surface F1 and the second holding surface F2 and is inclined with respect to the first holding surface F1. The second guide surface F4 is a surface connecting the second holding surface F2 and the first holding surface F1 and inclined with respect to the first holding surface F1. In FIGS. 9 to 11, the dot hatching drawn to the first cam part 152 represents the second holding surface F2.

The second cam part 153 is a portion that operates the mechanical clutch 120 in cooperation with a lever 160 to switch the mechanical clutch 120 between a transmission state and a disconnection state. The second cam part 153 is a plate cam projecting in the rotation axis direction of the cam 150 from a second surface 151B which is the other surface of the disk part 151. That is, the second cam part 153 projects from a side surface of the disk part 151 opposite to the side surface on which the first cam part 152 is disposed. The second cam part 153 extends in an arc shape when viewed from the rotation axis direction of the cam 150. The second cam part 153 is formed integrally with the disk part 151. Therefore, the second cam part 153 rotates together with the first cam part 152.

The phase detection wall 154 is a wall that is formed integrally with the disk part 151. The phase detection wall 154 extends in the circumferential direction about the rotation axis of the cam 150 and blocks light emitted by a light emitting element of a separation sensor 4 (see FIG. 9B). The phase detection wall 154 projects in the rotation axis direction of the cam 150 from the first surface 151A of the disk part 151 at a position closer to the rotation axis than the first cam part 152. That is, the phase detection wall 154 projects from the same side surface of the disk part 151 as the side surface on which the first cam part 152 is disposed, and is disposed inside an inner peripheral surface 152S of the first cam part 152. The phase detection wall 154 has a first slit 154A and a second slit 154B for indicating a phase in a rotation direction of the cam 150. The first slit 154A allows the light emitted by the light emitting element of the separation sensor 4 to pass therethrough when the developing roller 61 is at the separated position. The second slit 154B allows the light emitted by the light emitting element of the separation sensor 4 to pass therethrough when the developing roller 61 is at the contact position. The second slit 154B is different in size in the circumferential direction from the first slit 154A. Specifically, the size of the second slit 154B in the circumferential direction is larger than the size of the first slit 154A in the circumferential direction.

The housing 10 is provided with separation sensors 4 corresponding to black and cyan. The separation sensors 4 are phase sensors capable of detecting phases of the cams 150C and 150K. The separation sensor 4 includes a photo interrupter having a light emitting element and a light receiving element. The separation sensor 4 outputs an ON signal to the controller 2 when the first slit 154A or the second slit 154B is positioned between the light emitting element and the light receiving element and the light-receiving element receives light emitted by the light-emitting element, and outputs an OFF signal to the controller 2 when the phase detection wall 154 is between the light emitting element and the light receiving element to block the light emitted by the light emitting element and the light receiving element does not receive the light.

The light emitted from the light emitting element of the separation sensor 4 passes through the first slit 154A and the second slit 154B when the corresponding developing roller 61 is at the separated position and when the developing roller 61 is at the contact position, respectively. Therefore, the separation sensor 4 outputs the ON signal to the controller 2 when the corresponding developing roller 61 is at the separated position and the light emitted by the light emitting element passes through the first slit 154A and is received by the light receiving element. The separation sensor 4 outputs the ON signal to the controller 2 when the corresponding developing roller 61 is at the contact position and the light emitted by the light emitting element passes through the second slit 154B and is received by the light receiving element.

In the present embodiment, for the sake of convenience, the state of the separation sensor 4 in which the light receiving element is receiving the light is referred to as "ON," and the state of the separation sensor 4 in which the light receiving element is not receiving the light is referred to as "OFF." Either of a voltage for the ON signal or a voltage for the OFF signal may be higher.

Next, a configuration and function of the mechanical clutch 120 will be described.

Figure 7A:
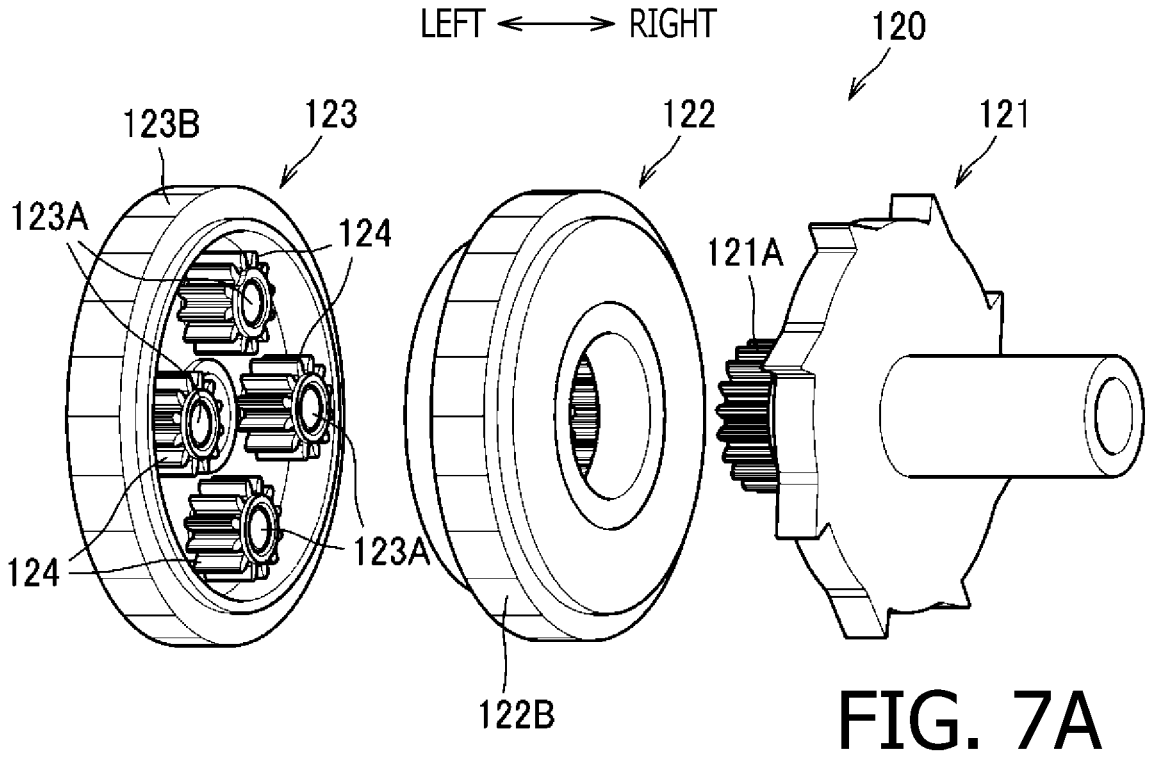
FIG. 7A is an exploded perspective view of a clutch as viewed from a sun gear side.
Figure 7B:
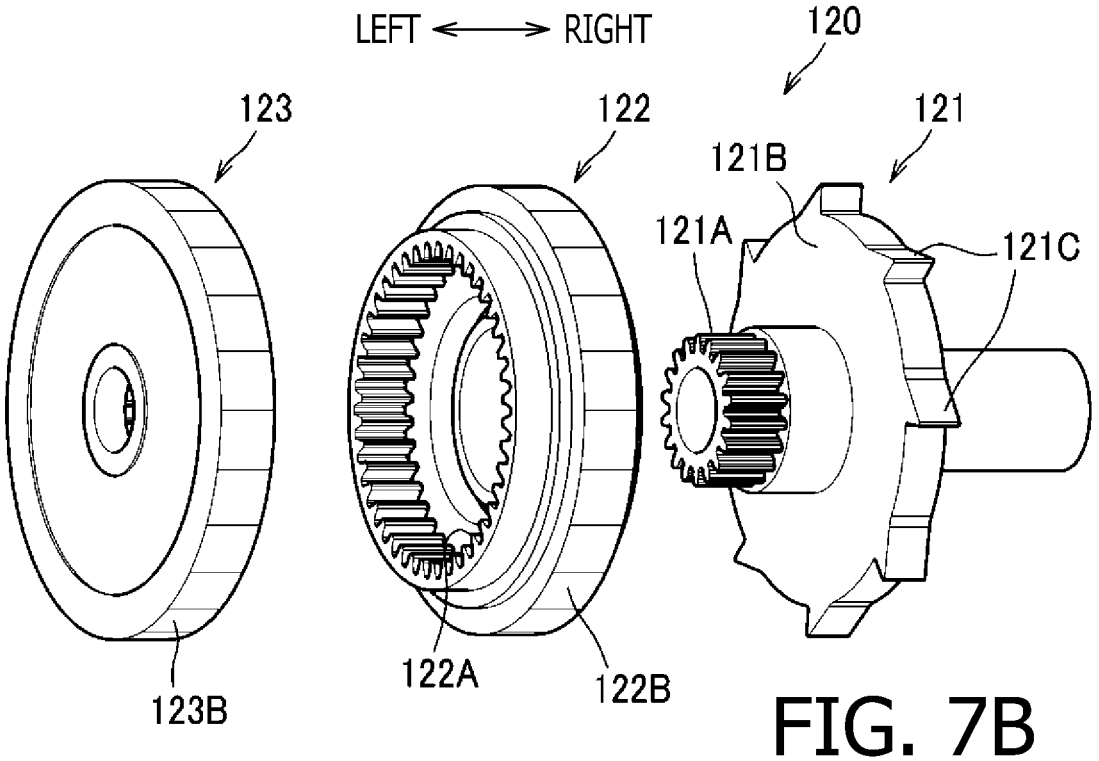
FIG. 7B is an exploded perspective view of the clutch as viewed from a career side.

As shown in FIGS. 7A and 7B, the mechanical clutch 120 has a planetary gear mechanism. The mechanical clutch 120 is configured to be switchable between a transmission state for transmitting the driving force from the first motor 3D to the developing roller 61 and a disconnection state for not transmitting the driving force from the first motor 3D to the developing roller 61. Specifically, the mechanical clutch 120 includes a sun gear 121, a ring gear 122 and a carrier 123 which are elements that are rotatable about one axis, and planetary gears 124 supported by the carrier 123.

The sun gear 121 includes a disk part 121B that rotates integrally with a gear part 121A, and a plurality of hook parts 121C provided on an outer periphery of the disk part 121B. The hook part 121C has a pointed tip, and the pointed tip is inclined in one rotation direction in the circumferential direction.

The ring gear 122 has an inner gear 122A provided on an inner peripheral surface thereof and an input gear 122B provided on an outer peripheral surface thereof.

The carrier 123 has four shaft parts 123A that rotatably support the planetary gears 124. The carrier 123 is also provided with an output gear 123B on an outer peripheral surface thereof.

Four planetary gears 124 are provided and are respectively rotatably supported by the shaft parts 123A of the carrier 123. The planetary gears 124 mesh with the gear part 121A of the sun gear 121 and the inner gear 122A of the ring gear 122.

Figure 9A:
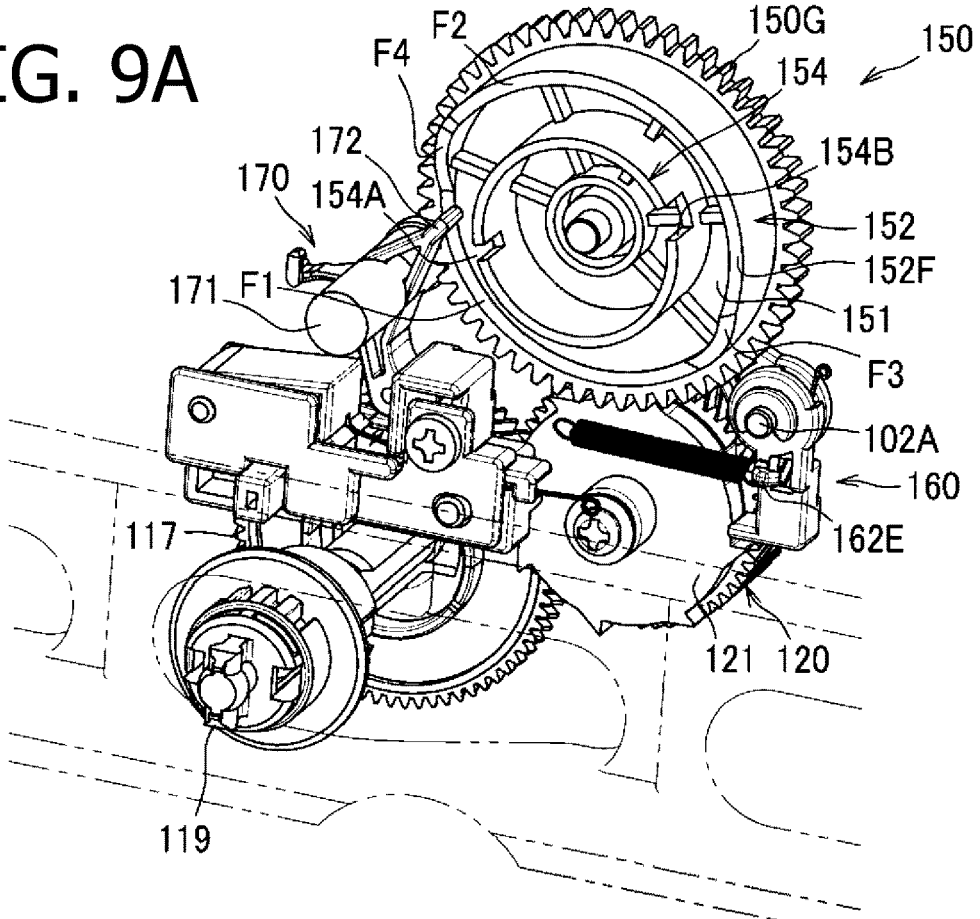
FIG. 9A is a perspective view illustrating the cam, the cam follower and a release member when the cam rotates forward and the developing roller is at a contact position.
Figure 9B:
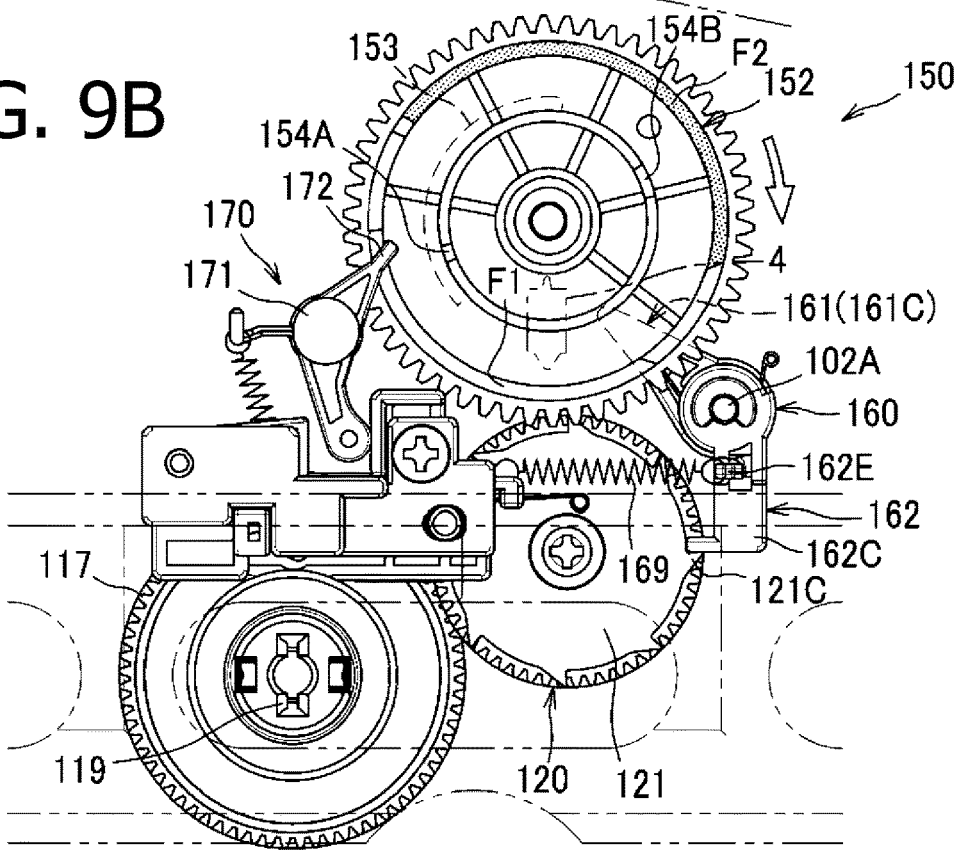
FIG. 9B is a side view illustrating the cam, the cam follower and the release member when the cam is rotated forward and the developing roller is at the contact position.

In the mechanical clutch 120, the input gear 122B meshes with a not-shown idle gear that receives the driving force of the first motor 3D and rotates, and the output gear 123B meshes with a coupling gear 117 shown in FIGS. 9A and 9B. The coupling shaft 119 is coaxially coupled to the coupling gear 117, and when the coupling gear 117 rotates, the coupling shaft 119 integrally rotates.

Next, operation of the mechanical clutch 120 will be described while referring back to FIG. 7. In a state in which the sun gear 121 is stopped so as not to rotate, the transmission state is established in which the driving force input to the input gear 122B can be transmitted to the output gear 123B. On the other hand, in a state in which the sun gear 121 can rotate, the disconnection state is established in which the driving force input to the input gear 122B cannot be transmitted to the output gear 123B. When the driving force is input to the input gear 122B in a state in which the mechanical clutch 120 is in the disconnection state and load is acting on the output gear 123B, the output gear 123B does not rotate and the sun gear 121 runs idle.

As shown in FIGS. 9A and 9B, the driving force transmission mechanism 100 further includes a plurality of levers 160 each configured to swing by being guided by the corresponding second cam part 153. the levers 160 are respectively swingably supported by support shafts 102A fixed to the housing 10. The levers 160 are provided to respectively correspond to yellow, magenta, cyan, and black.

In cooperation with the cam 150, the lever 160 engages with the sun gear 121 which is one element of the planetary gear mechanism to regulate the sun gear 121 so as not to rotate, thereby bringing the mechanical clutch 120 into the transmission state, or separates from the sun gear 121 to bring the mechanical clutch 120 into the disconnection state. The lever 160 switches the mechanical clutch 120 between the transmission state and the disconnection state when the cam 150 rotates in the forward direction, and maintains the mechanical clutch 120 in the disconnection state when the cam 150 rotates in the reverse direction.

Figure 8A:
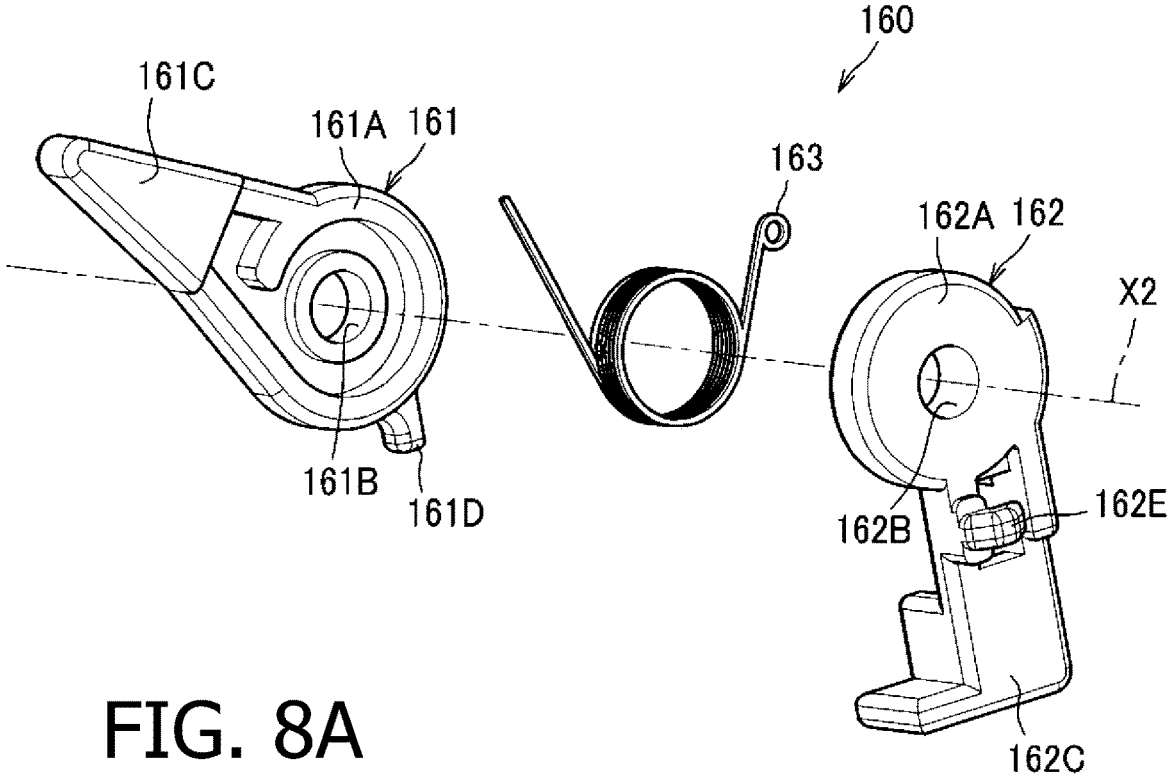
FIG. 8A is an exploded perspective view of a lever.

Specifically, as shown in FIG. 8A, the lever 160 includes a first lever 161, a second lever 162 and a second spring 163.

The first lever 161 is swingable about a swing axis X2 which is a center axis of the support shaft 102A, and can contact with the second cam part 153. The first lever 161 includes a rotation support part 161A having a hole 161B that fits to the support shaft 102A, a first arm 161C extending from the rotation support part 161A, and a projection 161D projecting from the rotation support part 161A to a side opposite to the first arm 161C.

Figure 8B:
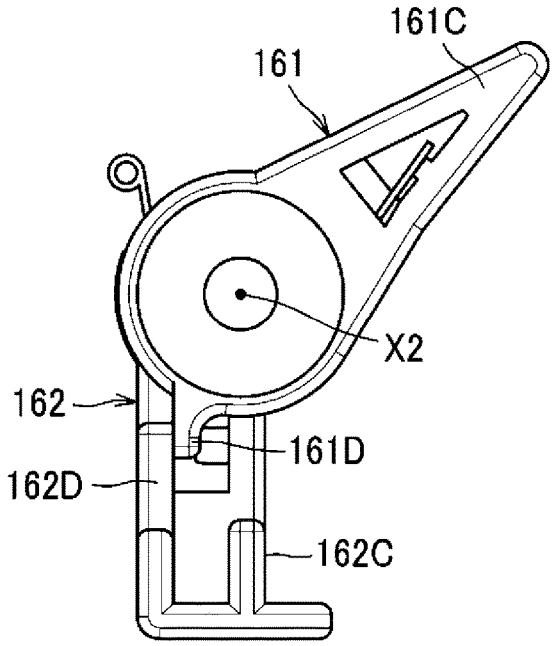
FIG. 8B is a diagram showing a state in which rotation of a first lever is restricted by a rotation restricting part.
Figure 8C:
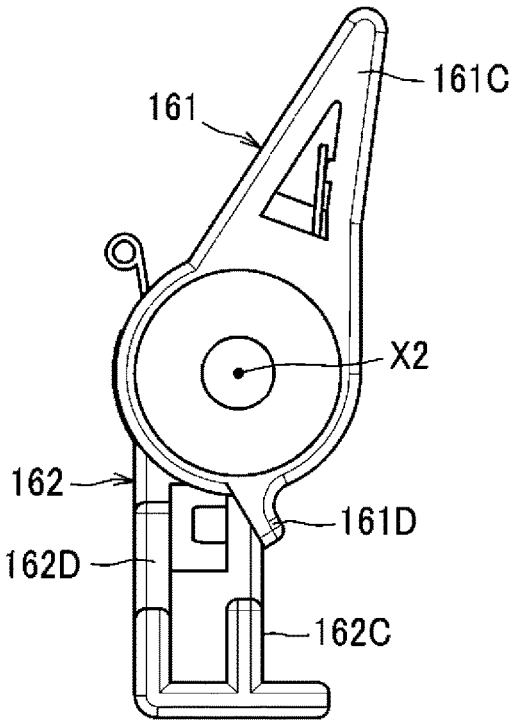
FIG. 8C is a diagram showing a state in which the first lever is swung with respect to a second lever.

The second lever 162 is swingable about the swing axis X2. The second lever 162 is engageable with the sun gear 121 which is one element of the mechanical clutch 120. The second lever 162 is combined with the first lever 161 and, as shown in FIGS. 8B and 8C, is swingable with respect to the first lever 161 about the swing axis X2. In other words, the first lever 161 is combined with the second lever 162 so as to be swingable about the swing axis X2 with respect to the second lever 162. A position of the first lever 161 shown in FIG. 8C at which the first lever 161 is swung with respect to the second lever 162 against the biasing force of the second spring 163 will be hereinafter referred to as a "swung position."

The second lever 162 includes a rotation support part 162A having a hole 162B that fits to the support shaft 102A, a second arm 162C extending from the rotation support part 162A, a rotation regulating part 162D and a spring hooking part 162E. The rotation regulating part 162D projects from the second arm 162C in a direction in which the swing axis X2 extends. As shown in FIG. 8B, rotation of the second lever 162 in one direction with respect to the first lever 161 is regulated as the projection 161D contacts the rotation regulating part 162D.

The second spring 163 is a torsion spring, and biases the first lever 161 with respect to the second lever 162 in a direction in which the projection 161D comes into contact with the rotation regulating part 162D. In other words, the second spring 163 generates a biasing force that makes the rotation regulating part 162D provided on the second lever 162 contact with the projection 161D of the first lever 161 so that the first lever 161 does not rotate with respect to the second lever 162.

In a state in which the first lever 161 and the second lever 162 are combined, a tip of the second arm 162C extends toward an outer peripheral surface of the disk part 121B of the sun gear 121. As shown in FIG. 9B, one end of a third spring 169 is hooked on the spring hooking part 162E. The third spring 169 is a tension spring, and the other end of the third spring 169 is hooked on a not-shown spring hooking part provided to the housing 10. Thus, the third spring 169 biases the second lever 162 clockwise in FIG. 9B. That is, the third spring 169 biases the second arm 162C of the second lever 162 in a direction in which the second arm 162C swings toward the outer peripheral surface of the sun gear 121 (the disk part 121B) which is one element of the planetary gear mechanism. The second arm 162C can restrict the rotation of the sun gear 121 by engaging with the hook part 121C of the outer peripheral surface of the sun gear 121.

A tip of the first arm 161C can contact an outer peripheral surface of the second cam part 153. The lever 160 is movable between a transmitting position shown in FIGS. 9A and 9B at which the tip of the first lever 161 is separated from the second cam part 153 and the second lever 162 is engaged with the hook part 121C of the mechanical clutch 120 to bring the mechanical clutch 120 into the transmission state, and a non-transmitting position shown in FIGS. 10A and 10B at which the tip of the first lever 161 contacts with the second cam part 153 and is pushed such that the tip of the second lever 162 which is one element of the planetary gear mechanism disengages from the hook part 121C of the sun gear 121 to bring the mechanical clutch 120 into the disconnection state.

In a state in which each lever 160 is at the transmitting position as shown in FIGS. 9A and 9B and the YMC clutch 140A and the K clutch 140K are ON, when the first motor 3D rotates in the first direction, the driving force transmission mechanism 100 can transmit the driving force to the agitators 67, the developing rollers 61 and the separation mechanisms. In this case, the cams 150 rotate clockwise in FIG. 9B.

In a state in which each lever 160 is at the transmitting position as Shown in FIGS. 9A and 9B and the YMC clutch 140A and the K clutch 140K are OFF, when the first motor 3D rotates in the first direction, the driving force transmission mechanism 100 can transmit the driving force to the agitators 67 and the developing rollers 61 but does not transmit the driving force to the separation mechanisms.

Figure 10A:
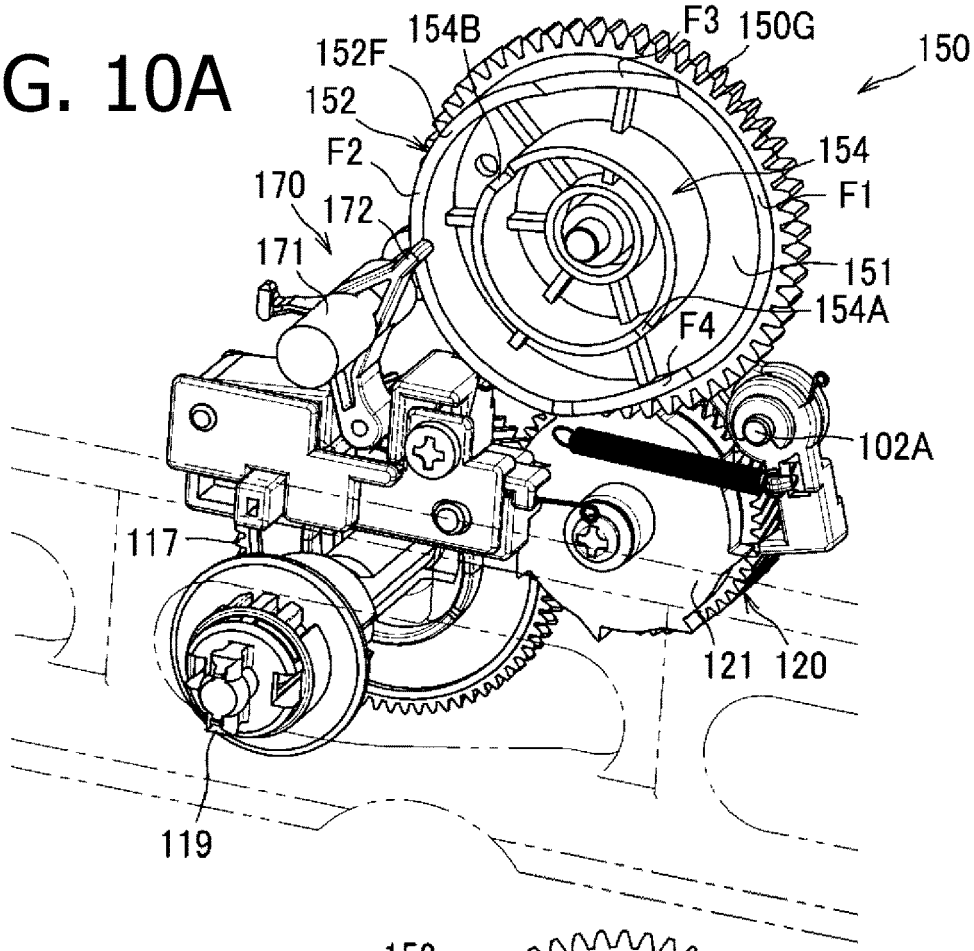
FIG. 10A is a perspective view illustrating the cam, the cam follower and the release member when the cam is rotated forward and the developing roller is at a separated position.
Figure 10B:
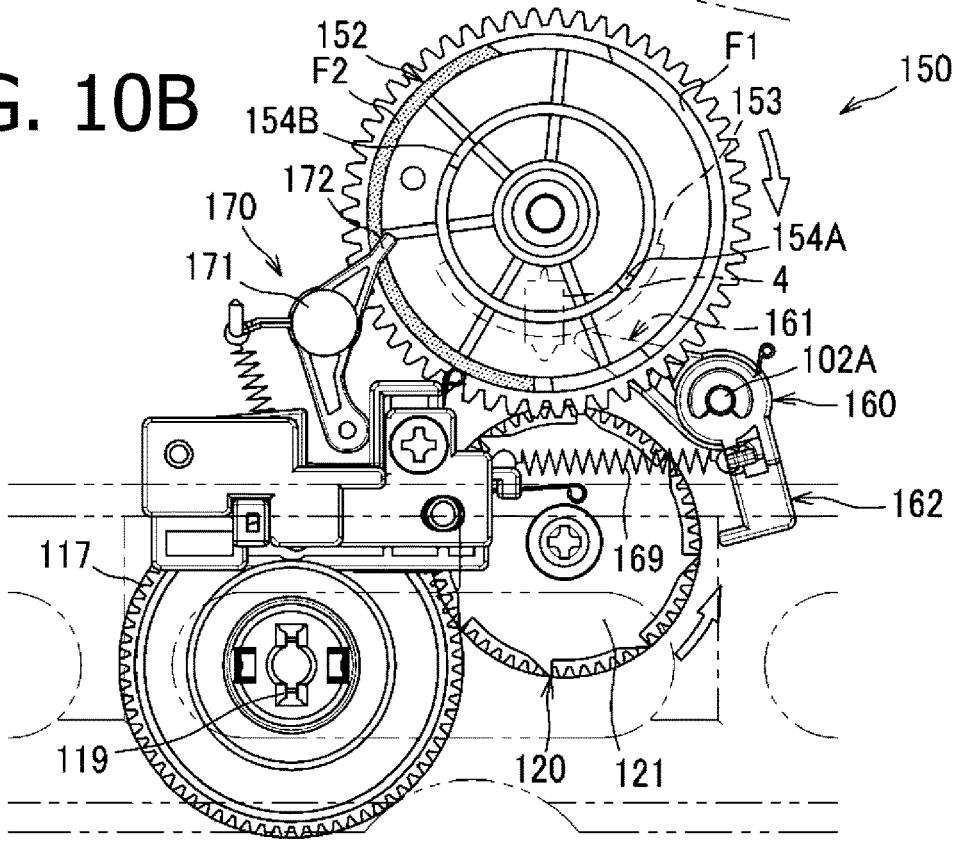
FIG. 10B is a side view illustrating the cam, the cam follower and the release member when the cam rotates forward and the developing roller is at the separated position.

In a state in which each lever 160 is at the non-transmitting position as shown in FIGS. 10A and 10B and the YMC clutch 140A and the K clutch 140K are ON, when the first motor 3D rotates in the first direction, the driving force transmission mechanism 100 does not transmit the driving force to the agitators 67 and the developing rollers 61 but can transmit the driving force to the separation mechanisms. In this case, each cam 150 rotates clockwise in FIG. 10B, and each sun gear 121 rotates counterclockwise. Then, as each cam 150 rotates, each lever 160 moves from the non-transmitting position shown in FIGS. 10A and 10B to the transmitting position shown in FIG. 11B.

In a state in which each lever 160 is at the non-transmitting position as shown in FIGS. 10A and 10B and the YMC clutch 140A and the K clutch 140K are OFF, when the first motor 3D rotates in the first direction, the driving force transmission mechanism 100 does not transmit the driving force to the agitators 67, the developing rollers 61 and the separation mechanisms. In this case, unlike the state shown in FIG. 10B, each cam 150 stops and each sun gear 121 rotates counterclockwise in FIG. 10B. This state is maintained until the YMC clutch 140A and the K clutch 140K are switched to ON.

Figure 11A:
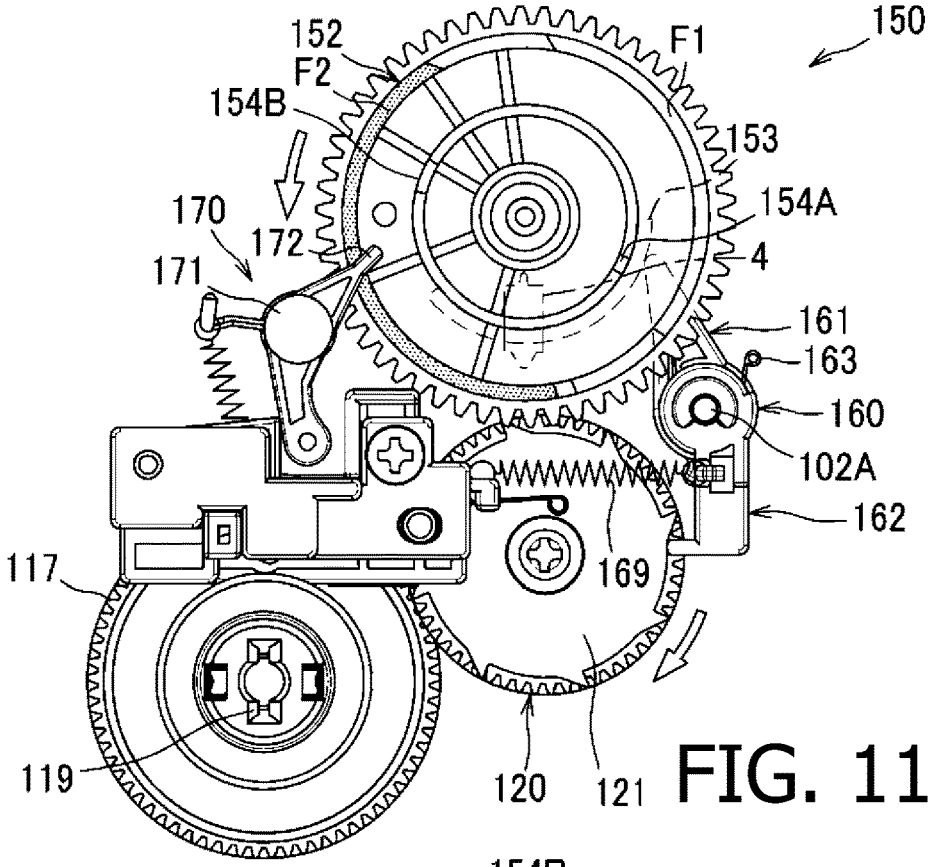
FIG. 11A is a side view showing the cam, the cam follower and the release member, and is a view illustrating a state in which the cam is rotated backward, the developing roller is at the separated position, and the first lever is at a swung position.

When the first motor 3D rotates in the second direction and each first lever 161 is pressed by the corresponding second cam part 153 in a state in which each second lever 162 is in contact with each hook part 121C of each sun gear 121 which is one element of the planetary gear mechanism, as shown in FIG. 11A, each first lever 161 swings with respect to the corresponding second lever 162 against the biasing force of the second spring 163 and moves to the swung position. Since each first lever 161 can swing with respect to the corresponding second lever 162 as described above, excessive force does not act on the levers 160 when the first motor 3D is rotated in the second direction.

In a state in which the first motor 3D rotates in the second direction and the tip of each second lever 162 is in contact with the corresponding hook part 121C, each sun gear 121 rotates clockwise in the drawing. In this case, since the inclined surface of each hook part 121C comes into contact with the tip of the corresponding second lever 162, each hook part 121C pushes the corresponding second lever 162 in the radial direction due to the rotation of the corresponding sun gear 121. Therefore, each sun gear 121 rotates clockwise while flicking the corresponding second lever 162. Since each second lever 162 does not stop the rotation of the corresponding sun gear 121 in the manner described above, each mechanical clutch 120 is in the disconnected state. That is, when the first motor 3D rotates in the second direction, the mechanical clutches 120 are in the disconnected state and therefore the developing rollers 61 and the agitators 67 do not rotate.

That is, in a state in which the YMC clutch 140A and the K clutch 140K are ON, when the first motor 3D rotates in the second direction, the driving force transmission mechanism 100 does not transmit the driving force to the agitators 67 and the developing rollers 61 but can transmit the driving force to the separation mechanism. On the other hand, in a state in which the YMC clutch 140A and the K clutch 140K are OFF, when the first motor 3D rotates in the second direction, the driving force transmission mechanism 100 does not transmit the driving force to the agitators 67, the developing rollers 61 and the separation mechanisms.

Next, a control method by the controller 2 will be described.

The controller 2 is a device that controls the overall operation of the image forming apparatus 1. The controller 2 includes a CPU, a ROM, a RAM, an input/output interface and the like, and executes each process by executing one or more programs stored therein.

In the present embodiment, the controller 2 controls the YMC clutch 140A and the K clutch 140K based on the signals from the separation sensors 4 to control the contact and separation of the developing roller 61 with respect to the photosensitive drum 50.

When forming an image on the sheet S, the controller 2 rotates the first motor 3D at a first speed to rotate the agitators 67 at a third speed, and executes an image forming process. In the image forming process, the controller 2 rotates the photosensitive drums 50, the conveying belt 73, the heating roller 81 and the pressing roller 82.

In response to the image forming apparatus 1 being turned on or in response to the cover 11 being moved from the open position to the closed position, the controller 2 executes an initial separation process of rotating the first motor 3D at the first speed to position the developing rollers 61 of the plurality of developing cartridges 60 at the separated position, and then executes a determination process of determining whether one or more new developing cartridges 60 are included in the plurality of developing cartridges 60. That is, the controller 2 executes the initial separation process before the determination process.

In the initial separation process, the controller 2 rotates the first motor 3D in the second direction. When executing the initial separation process, the controller 2 rotates the first motor 3D in a state where the second motor 3P and the third motor 3F are stopped. That is, the controller 2 executes the initial separation process without rotating the photosensitive drums 50, the conveying belt 73, and the heating roller 81.

The controller 2 executes the determination process by reading, from each memory 68, identification data indicating whether the developing cartridge 60 to which the memory 68 is provided is new.

As a result of the determination process, when one or more new developing cartridges 60 are included in the plurality of developing cartridges 60, the controller 2 executes an initial stirring process of stirring the toner with the agitators 67. In the initial stirring process, the controller 2 rotates the agitators 67 at a fourth speed slower than the third speed by rotating the first motor 3D in the first direction at a second speed slower than the first speed. The first speed is a maximum speed of the first motor 3D and is also referred to as "full speed." The second speed is half of the first speed and is also referred to as a "half speed." Rotation speeds of the second motor 3P and the third motor 3F are also referred to as "full speed" when they rotate at their maximum speeds.

When executing the initial stirring process, the controller 2 rotates the first motor 3D in a state where the second motor 3P and the third motor 3F are stopped. That is, in the initial stirring process, the controller 2 rotates the agitators 67 without rotating the photosensitive drums 50, the conveying belt 73 and the heating roller 81.

On the other hand, when no new developing cartridge 60 is not included in the plurality of developing cartridges 60, the controller 2 does not execute the initial stirring process but executes a subsequent process such as cleaning of the conveying belt 73, initialization of the fuser 80 or the like.

An example of a specific process by the controller 2 that realizes the control described above will be described with reference to FIGS. 12 and 13. In the drawings, the term "developing cartridge 60" is abbreviated to a term "cartridge."

Figure 12:
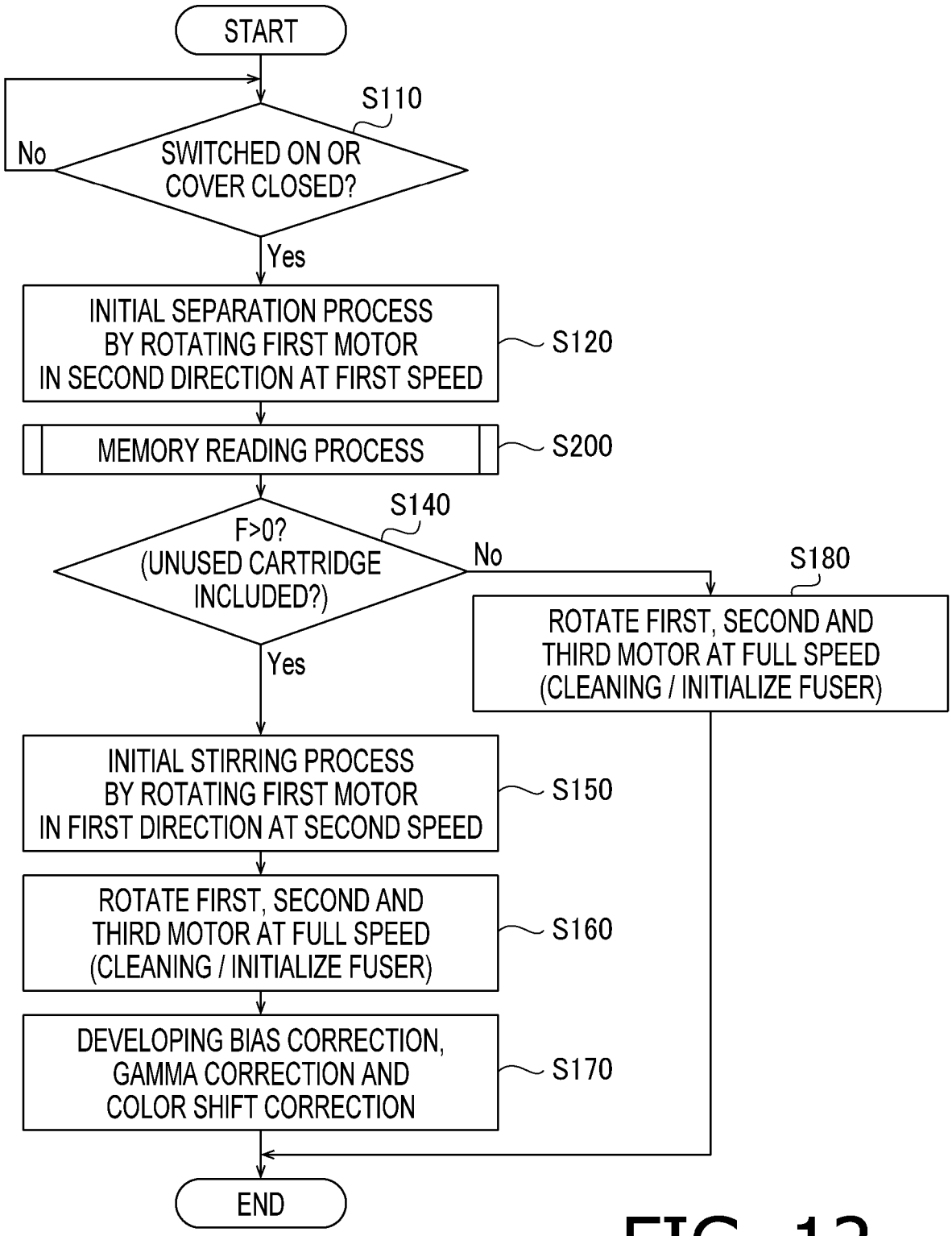
FIG. 12 is a flowchart showing processes by the controller in response to the image forming apparatus being turned on or in response to a cover being closed.

As shown in FIG. 12, when it is determined that the image forming apparatus 1 is turned on or the cover 11 is closed (S110: Yes), the controller 2 executes initial operations of on and after step S120. When executing the initial operations, the controller 2 rotates the first motor 3D in the second direction at the first speed to execute the initial separation process (S120). As a result, each developing roller 61 moves to the separated position.

Figure 13:
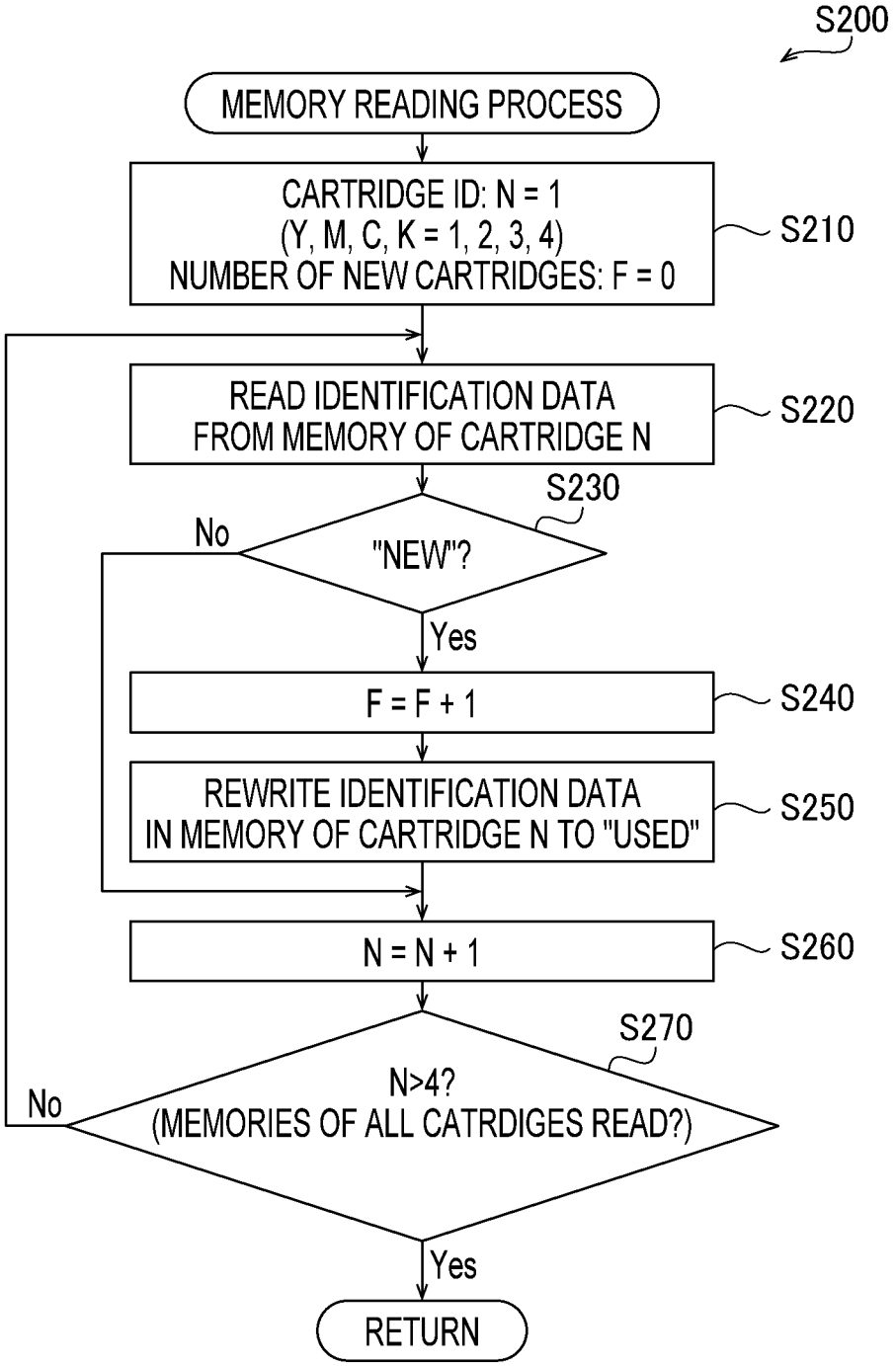
FIG. 13 is a flowchart of a memory reading process.

After the initial separation process, the controller 2 executes a memory reading process (S200). As shown in FIG. 13, in the memory reading process (S200), the controller 2 firstly initializes a variable N indicating a cartridge ID to 1 and a variable F indicating the number of new developing cartridges 60 to 0 (S210).

Then, the controller 2 reads the identification information from the memory 68 of the N-th developing cartridge 60 (S220), and determines whether the read identification information indicates that the cartridge is new (S230). When it is determined that the identification data indicates that the cartridge is new (S230: Yes), the controller 2 increments the variable F (S240) and rewrites the identification datum of the memory 68 of the N-th developing cartridge 60 to the data indicating that the cartridge is used (S250).

After step S250 or when it is determined in step S230 that the identification information does not indicate that the cartridge is new (S230: No), the controller 2 increments the variable N (S260).

The controller 2 determines whether or not the variable N is larger than 4 (i.e., whether or not the memory reading for all the cartridges is completed) (S270), and when it is determined that the variable N is not larger than 4 (S270: No), the process returns to step S220 to repeat the processes. On the other hand, when it is determined that the variable N is larger than 4 (S270: Yes), the controller 2 terminates the memory reading process (S200).

Referring back to FIG. 12, after the memory reading process (S200), the controller 2 determines whether the variable F is larger than 0 (i.e., whether there is one or more new cartridges) (S140). When it is determined that the variable F is larger than 0 (S140: Yes), the controller 2 rotates the first motor 3D in the first direction at the second speed to execute the initial stirring process (S150). Then, the controller 2 rotates the first motor 3D, the second motor 3P and the third motor 3F at full speeds (i.e., maximum speeds of respective motors) and executes cleaning of the conveying belt 73 and initialization of the fuser 80 (S160). Then, the controller 2 develops a patch pattern of predetermined densities and colors on the conveying belt 73, reads the patch pattern with a conventionally-known sensor, executes a developing bias correction, a gamma correction and a color shift correction (S170), and terminates the initial operation.

On the other hand, when it is determined in step S140 that the variable F is not larger than 0 (S140: No), the controller 2 does not execute the initial stirring process (S150) but rotates the first motor 3D, the second motor 3P and the third motor 3F at full speeds (i.e., maximum speeds of respective motors), executes cleaning of the conveying belt 73 and initialization of the fuser 80 (S180), and terminates the initial operation.

An exemplary initial operation of the image forming apparatus 1 by the above-described process will be described with reference to FIGS. 14 and 15. Operations relating to the developing cartridges 60 for yellow, magenta and cyan and the YMC clutch 140A will be hereinafter described, but operations relating to the developing cartridge 60 for black are similar.

Figures 14A, 14B, 14C, 14D, 14E, 14F, 14G:
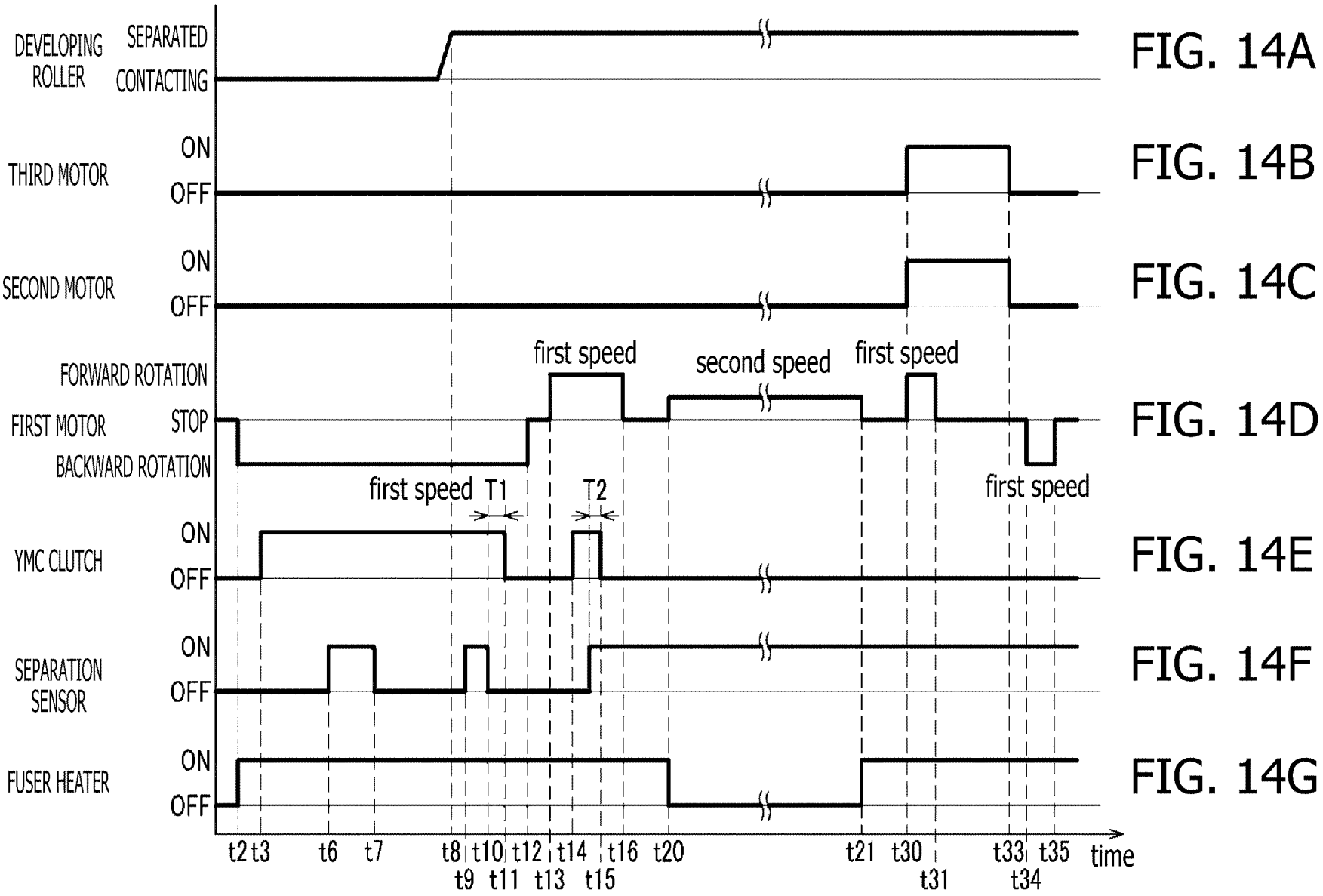
FIG. 14A is a timing chart for explaining operation of the developing roller in response to the image forming apparatus being turned on, and illustrates a case where a new developing cartridge is mounted.
FIG. 14B is a timing chart for explaining operation of a third motor in response to the image forming apparatus being turned on, and illustrates a case where a new developing cartridge is mounted.
FIG. 14C is a timing chart for explaining operation of a second motor in response to the image forming apparatus being turned on, and illustrates a case where a new developing cartridge is mounted.
FIG. 14D is a timing chart for explaining operation of a first motor in response to the image forming apparatus being turned on, and illustrates a case where a new developing cartridge is mounted.
FIG. 14E is a timing chart for explaining operation of a YMC clutch in response to the image forming apparatus being turned on, and illustrates a case where a new developing cartridge is mounted.
FIG. 14F is a timing chart for explaining operation of a separation sensor in response to the image forming apparatus being turned on, and illustrates a case where a new developing cartridge is mounted.
FIG. 14G is a timing chart for explaining operation of a heater in response to the image forming apparatus being turned on, and illustrates a case where a new developing cartridge is mounted.

FIG. 14 shows an initial operation when one or more new developing cartridges 60 are included in the plurality of mounted developing cartridges 60.

After the cover 11 is moved to the closed position or after the image forming apparatus 1 is turned on, the controller 2 rotates the first motor 3D backward at the first speed and turns on the heater 81A of the fuser 80 at the same time to start pre-heating (t2), and switches the YMC clutch 140A to ON (t3). The cams 150 thereby rotate backward. In the backward rotation of each cam 150, the second slit 154B is detected by the separation sensor 4 and the long ON signal is output from the separation sensor 4 (t6 to t7). When the cam 150 further rotates backward, as shown in FIG. 11A, the contact part 172 moves onto the second holding surface F2 and the cam follower 170 moves to the protruding position, and the developing roller 61 moves to the separated position (t8). When the first slit 154A passes through the separation sensor 4, the signal from the separation sensor 4 changes to ON (t9) and then changes to OFF (t10). Then, the first lever 161 of the lever 160 comes into contact with the second cam part 153. At this time, since the second lever 162 remains in contact with the sun gear 121, the second lever 162 cannot move, and instead, the first lever 161 swings to the swung position against the biasing force of the second spring 163. Further, upon a particular period of time T1 elapses after the separation sensor 4 is switched to OFF (t10), the controller 2 switches the YMC clutch 140A to OFF (t11) and stops the first motor 3D (t12).

Figure 11B:
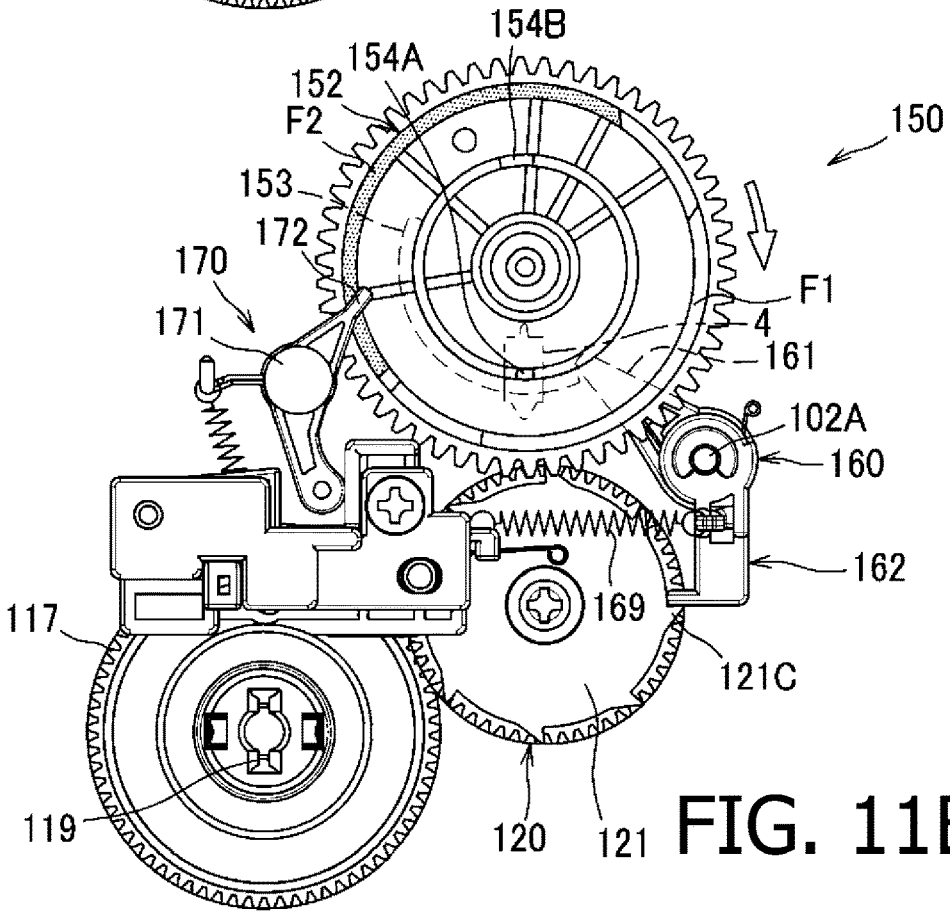
FIG. 11B is a side view showing the cam, the cam follower and the release member, and is a view illustrating a state in which the cam is rotated forward from the state shown in FIG. 11A and is stopped.

Then, the controller 2 rotates the first motor 3D forward at the first speed (t13) and switches the YMC clutch 140A to ON (t14) to slightly rotate the cams 150 forward. After each cam 150 rotated forward by a particular angle and a particular period of time T2 elapsed after the first slit 154A reached the separation sensor 4 and the separation sensor 4 is switched to ON, the controller 2 switches the YMC clutch 140A to OFF (t15). Then, the controller 2 stops the first motor 3D (t16). At this time, as shown in FIG. 11B, the contact part 172 is on the second holding surface F2 and the cam follower 170 is at the protruding position and, as a result, the developing rollers 61 are at the separated position. Further, each lever 160 is in a state in which the second lever 162 is engaged with the hook part 121C of the sun gear 121, and the tip of the first lever 161 is separated rightward from the second cam part 153. Thus, the initial separation process ends. In the initial separation process, after the first motor 3D is reversely rotated, the first motor 3D is slightly rotated forward in order to adjust the phases of the cams 150. However, since the amount of the forward rotation is very small and each sun gear 121 needs to rotate to some extent before the second lever 162 engages with the hook part 121C of the sun gear 121, the agitators 67 do not rotate at all or rotate only slightly by this forward rotation of the first motor 3D.

After the initial separation process, the controller 2 turns off the heater 81A of the fuser 80 to interrupt the pre-heating (t20), and rotates the first motor 30D forward at the second speed (t20 to t21) while keeping the YMC clutch 140A at OFF to execute the initial stirring process. In the initial stirring process, the second motor 3P and the third motor 3F remain stopped. As a result, the agitators 67 rotate at the fourth speed slower than the third speed for forming an image and agitate the toner in the storage chambers. Since the first motor 3D rotates at the second speed, the agitators 67 can be rotated with large torque. Therefore, even if the toners in one or more new developing cartridges 60 are solidified, the toners can be loosened and stirred with the agitators 67.

After the initial stirring process is executed for a particular period of time (for example, for 30 seconds), the controller 2 turns on the heater 81A of the fuser 80 to restart the pre-heating (t21), rotates the first motor 3D forward at the first speed (t30 to t31), and then rotates the first motor 3D backward at the first speed (t34 to t35) to operate the nip pressure adjusting mechanism 85 of the fuser 80 to execute an operation of separating the pressing roller 82 from the heating roller 81 and an operation of returning the pressing roller 82 to the original position.

At t30, the controller 2 rotates the second motor 3P and the third motor 3F at full speed (t30 to t33) in synchronization with the start of forward rotation of the first motor 3D. As a result, the conveying belt 73 is cleaned, and the heating roller 81 and the pressing roller 82 rotate in a state in which the heater 81A of the fuser 80 is on. By rotating the heating roller 81 and the pressing roller 82 in the state in which the heater 81A of the fuser 80 is on, temperatures of surfaces of the heating roller 81 and the pressing roller 82 are uniformed. In addition, since the heating roller 81 and the pressing roller 82 are in contact with each other, it is possible to remove crease (nip mark) such as unevenness and wrinkle generated on the pressing roller 82.

Thereafter, although not shown, correction process using the patch pattern is executed, and the initial operation ends.

Figures 15A, 15B, 15C, 15D, 15E, 15F, 15G:
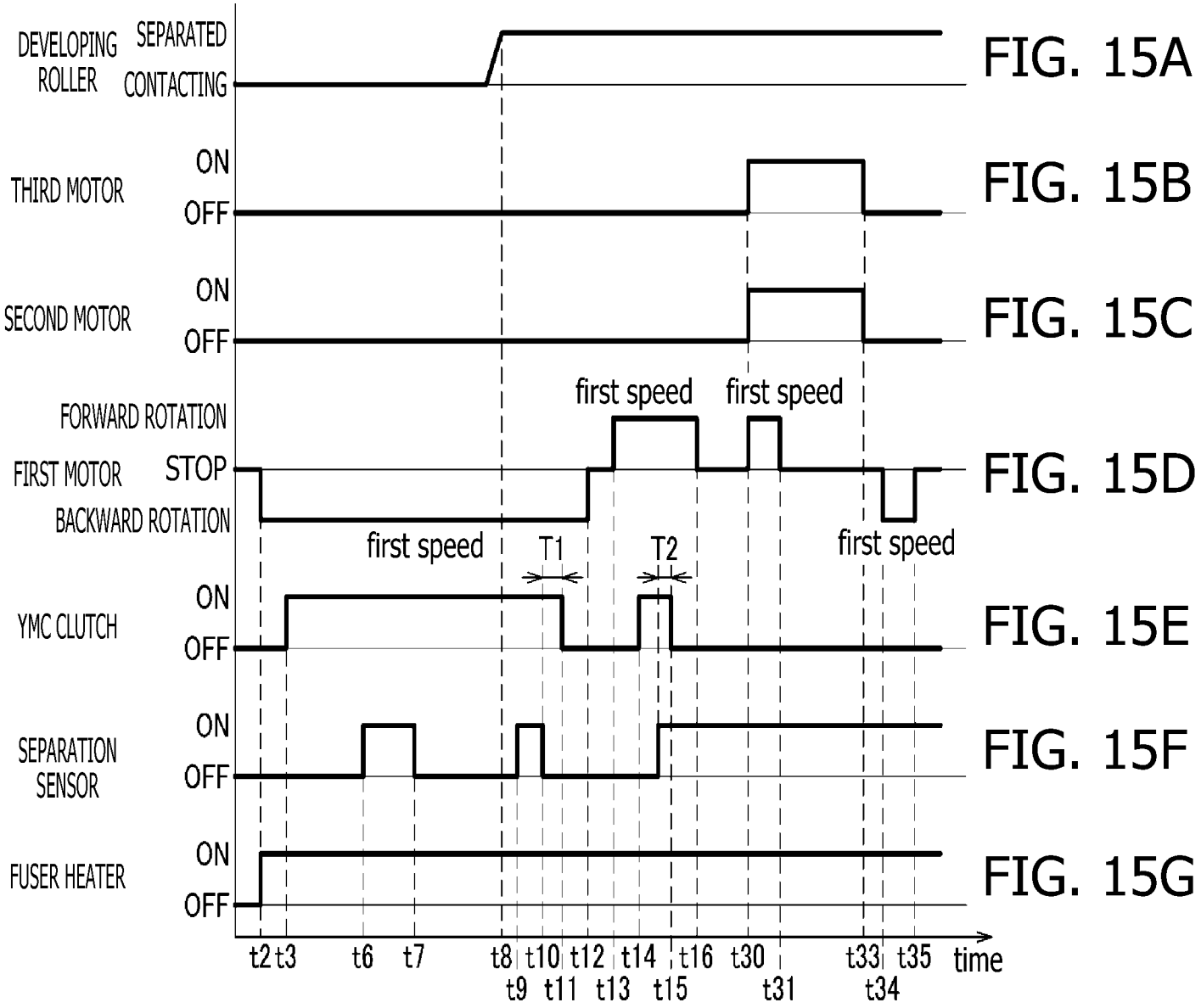
FIG. 15A is a timing chart for explaining the operation of the developing roller in response to the image forming apparatus being turned on, and illustrates a case where only non-new developing cartridges are mounted.
FIG. 15B is a timing chart for explaining the operation of the third motor in response to the image forming apparatus being turned on, and illustrates a case where only non-new developing cartridges are mounted.
FIG. 15C is a timing chart for explaining the operation of the second motor in response to the image forming apparatus being turned on, and illustrates a case where only non-new developing cartridges are mounted.
FIG. 15D is a timing chart for explaining the operation of the first motor in response to the image forming apparatus being turned on, and illustrates a case where only non-new developing cartridges are mounted.
FIG. 15E is a timing chart for explaining the operation of the YMC clutch in response to the image forming apparatus being turned on, and illustrates a case where only non-new developing cartridges are mounted.
FIG. 15F is a timing chart for explaining the operation of the separation sensor in response to the image forming apparatus being turned on, and illustrates a case where only non-new developing cartridges are mounted.
FIG. 15G is a timing chart for explaining the operation of the heater in response to the image forming apparatus being turned on, and illustrates a case where only non-new developing cartridges are mounted.

On the other hand, in a case where no new developing cartridge 60 is included in the plurality of mounted developing cartridges 60, as shown in FIG. 15, after the initial separation process at t2 to t16, the initialization of the fuser 80 and the cleaning of the conveying belt 73 are executed (t30 to t35) without executing the initial stirring process (t20 to t21 in FIG. 14). Thus, the initial operation can be completed quickly without unnecessarily stirring the toners.

As described above, according to the image forming apparatus 1 of the present embodiment, when one or more new developing cartridges 60 are mounted, since the first motor 3D is rotated at the second speed slower than the speed for forming an image so that the agitators 67 rotate at the fourth speed slower than the speed for forming an image to execute the initial agitating process, the torque of the first motor 3D can be increased, and the toners can be easily loosened even when the toners are solidified. In addition, in a case where only the used developing cartridges 60 are mounted, since the initial stirring process is not executed, unnecessary stirring of the toners is suppressed. As a result, deterioration of the toners can be suppressed, and wasteful power consumption can also be suppressed.

Since the controller 2 reads the identification information from the memories 68 to perform the determination process, it is not necessary to operate the first motor 3D in the determination process and therefore unnecessary stirring of the toner is suppressed.

In addition, since the controller 2 executes the initial stirring process in a state in which each developing roller 61 is at the separated position, it is possible to reduce load on the first motor 3D in the initial stirring process. Furthermore, since the determination process is executed in a state in which each developing roller 61 is at the separated position, even when a user does not correctly mount the developing cartridges 60, positions of the developing cartridges 60 are corrected before the determination process by the operation of moving the developing cartridges 60 to move the developing rollers 61 to the separated positions. Therefore, connections between contact points of the memories 68 and contact points of the drawer 90 are ensured before the determination process and identification data in the memories 68 can be read correctly.

In addition, since the controller 2 does not rotate the agitators 67 and the developing rollers 61 in the initial separation process, it is possible to reduce the load on the first motor 3D in the initial separation process and to suppress deterioration of the toners and the developing rollers 61.

Hereinabove, the illustrative embodiments according to aspects of the present disclosure have been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only exemplary illustrative embodiments of the present disclosure and but a few examples of their versatility are shown and described in the present disclosure. It is to be understood that the present disclosure is capable of use in various other combinations and environments and is capable of changes or modifications within the scope of the inventive concept as expressed herein.

The configuration of the driving force transmission mechanism 100 in the above-described embodiment is merely an exemplary configuration that enables execution of the initial separation process. Therefore, another configuration that enables execution of the initial separation process may be adopted. For example, in the above-described embodiment, the driving force transmission mechanism 100 is configured such that the initial separation process is executed by rotating the first motor 3D in the second direction, but a driving force transmission mechanism that is configured such that the initial separation process is executed by rotating the first motor 3D in the first direction may be adopted.

The above-described embodiment is configured such that the mechanisms of the image forming apparatus 1 is driven using three motors (the first motor 3D, the second motor 3P and the third motor 3F). However, the mechanism does not necessarily have to be driven using three motors. For example, by providing a motor dedicated to the initial separation process separately, the initial separation process can be executed without providing a cam mechanism such as the one provided in the above-described embodiment.

The initial stirring process may also be performed without performing the initial separation process. In this case, the load on the first motor 3D cannot be reduced, and the second motor 3P is also driven. However, it is possible to suppress unnecessary stirring of the toners in a case where only used developing cartridges 60 are mounted.

In the above-described embodiment, the initialization of the fuser 80 is executed after the initial stirring process is completed. However, with a configuration in which the nip pressure adjusting mechanism 85 of the fuser 80 is driven using a motor different from the first motor 3D, the initialization of the fuser 80 may be executed simultaneously with the initial stirring process. The cleaning of the conveying belt 73 may also be performed simultaneously with the initial stirring process.

Figures 16A, 16B, 16C, 16D, 16E, 16F, 16G:
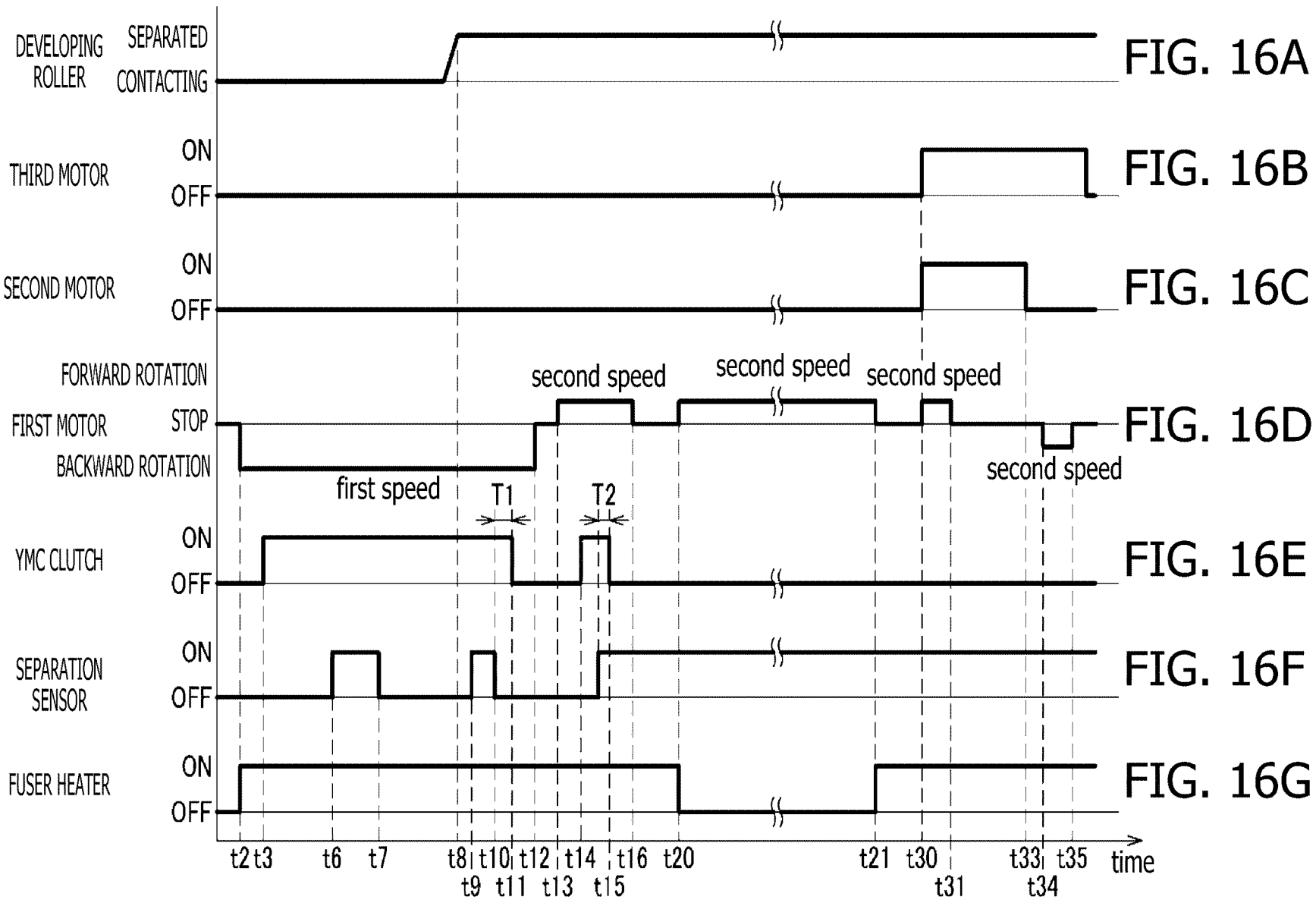
FIG. 16A is a timing chart for explaining the operation of the developing roller in response to the image forming apparatus being turned on, and illustrates a modified example of the case where a new developing cartridge is mounted.
FIG. 16B is a timing chart for explaining the operation of the third motor in response to the image forming apparatus being turned on, and illustrates a modified example of the case where a new developing cartridge is mounted.
FIG. 16C is a timing chart for explaining the operation of the second motor in response to the image forming apparatus being turned on, and illustrates a modified example of the case where a new developing cartridge is mounted.
FIG. 16D is a timing chart for explaining the operation of the first motor in response to the image forming apparatus being turned on, and illustrates a modified example of the case where a new developing cartridge is mounted.
FIG. 16E is a timing chart for explaining the operation of the YMC clutch in response to the image forming apparatus being turned on, and illustrates a modified example of the case where a new developing cartridge is mounted.
FIG. 16F is a timing chart for explaining the operation of the separation sensor in response to the image forming apparatus being turned on, and illustrates a modified example of the case where a new developing cartridge is mounted.
FIG. 16G is a timing chart for explaining the operation of the heater in response to the image forming apparatus being turned on, and illustrates a modified example of the case where a new developing cartridge is mounted.
Figures 17A, 17B, 17C, 17D, 17E, 17F, 17G:
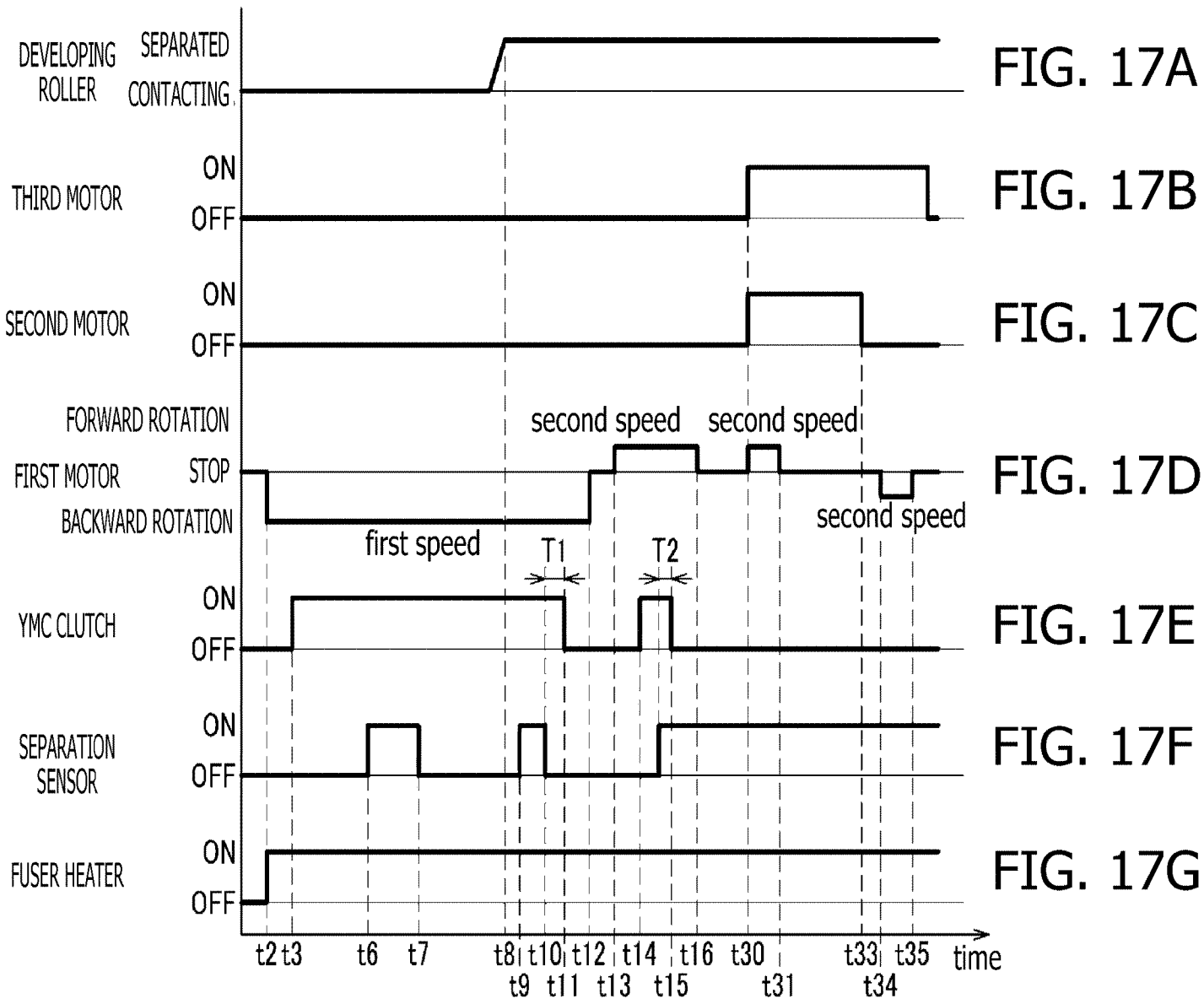
FIG. 17A is a timing chart for explaining the operation of the developing roller in response to the image forming apparatus being turned on, and illustrates a modified example of the case where only non-new developing cartridges are mounted.
FIG. 17B is a timing chart for explaining the operation of the third motor in response to the image forming apparatus being turned on, and illustrates a modified example of the case where only non-new developing cartridges are mounted.
FIG. 17C is a timing chart for explaining the operation of the second motor in response to the image forming apparatus being turned on, and illustrates a modified example of the case where only non-new developing cartridges are mounted.
FIG. 17D is a timing chart for explaining the operation of the first motor in response to the image forming apparatus being turned on, and illustrates a modified example of the case where only non-new developing cartridges are mounted.
FIG. 17E is a timing chart for explaining the operation of the YMC clutch in response to the image forming apparatus being turned on, and illustrates a modified example of the case where only non-new developing cartridges are mounted.
FIG. 17F is a timing chart for explaining the operation of the separation sensor in response to the image forming apparatus being turned on, and illustrates a modified example of the case where only non-new developing cartridges are mounted.
FIG. 17G is a timing chart for explaining the operation of the heater in response to the image forming apparatus being turned on, and illustrates a modified example of the case where only non-new developing cartridges are mounted.

In the above-described embodiment, as shown in FIGS. 14 and 15, in the initial separation process, the first motor 3D is rotated backward at the first speed (t2 to t12) and then rotated forward at the first speed (t13 to t16). However, as shown in FIGS. 16 and 17, the first motor 3D may be rotated backward at the first speed (t2 to t12) and then rotated forward at the second speed (t13 to t16).

In the above-described embodiment, as shown in FIGS. 14 and 15, after the initial stirring process is executed, in order to operate the nip pressure adjusting mechanism 85 of the fuser 80 to execute the operation of separating the pressing roller 82 from the heating roller 81 and returning the pressing roller 82 to the original position, the first motor 3D is rotated forward at the first speed (t30 to t31) and is then rotated backward at the first speed (t34 to t35). However, as shown in FIGS. 16 and 17, the first motor 3D may be rotated forward at the second speed (t30 to t31) and may then be rotated backward at the second speed (t34 to t35) in order to operate the nip pressure adjusting mechanism 85 of the fuser 80.

In the above-described embodiment, as shown in FIGS. 14 and 15, the second motor 3P and the third motor 3F are simultaneously rotated and stopped (t30 to t33). However, the second motor 3P and the third motor 3F do not necessarily have to be rotated and stopped simultaneously. For example, as shown in FIGS. 16 and 17, the timing of stopping the third motor 3F may be delayed.

In the above-described embodiment, the conveying belt 73 is adopted as an example of a belt, but the belt may be an intermediate transfer belt.

In the above-described embodiment, the developing cartridge 60 is adopted as an example of a cartridge, but the cartridge may be a process cartridge including a photosensitive drum.

In the above-described embodiment, the heating roller 81 is adopted as an example of a rotating body, but the rotating body may be an endless belt.

In the above-described embodiment, the image forming apparatus 1 that prints a color image using toners of four colors is illustrated as an example of an image forming apparatus, but the image forming apparatus may be an apparatus that prints a color image using toners of two colors, three colors or five or more colors, or an apparatus that performs monochrome printing using a toner of one color.

The image forming apparatus may be a multifunction peripheral or a copier.

The elements described in the above-described embodiment and variations can be implemented in appropriate combinations.

The plurality of developing cartridges 60 in the above-described embodiment is an example of a plurality of cartridges according to aspects of the present disclosures. The conveying belt 73 in the above-described embodiment is an example of a belt according to aspects of the present disclosures. The heating roller 81 in the above-described embodiment is an example of a rotating body according to aspects of the present disclosures.

What is claimed is:

1. An image forming apparatus comprising:

a housing having an opening;

a cover movable between a closed position for closing the opening and an open position for opening the opening;

a plurality of photosensitive drums;

a plurality of cartridges each having a developing roller, a storage chamber configured to store toner, and an agitator configured to agitate the toner, the plurality of cartridges being configured to be mounted to the housing through the opening;

a first motor configured to rotate the agitators; and a controller configured to:

rotate the agitators by rotating the first motor when forming an image on a sheet; and in response to the image forming apparatus being turned on or in response to the cover being moved from the open position to the closed position:

execute a determination process of determining whether a new cartridge is included in the plurality of cartridges;

execute an initial stirring process of stirring toner with the agitators by rotating the first motor in a case where a new cartridge is included; and not execute the initial stirring process in a case where a new cartridge is not included, wherein the controller is further configured to rotate the agitators by rotating the first motor at a first speed when forming an image on a sheet, and wherein the controller executes the initial stirring process by rotating the first motor at a second speed slower than the first speed.

2. The image forming apparatus of claim 1, wherein each of the plurality of cartridges has a memory storing identification data indicating whether the cartridge is new, and wherein the controller executes the determination process by reading the identification data from the memories.

3. The image forming apparatus of claim 1, further including a plurality of separation mechanisms configured to move the developing rollers, respectively, each separation mechanism being configured to move a corresponding developing roller between a contact position at which the developing roller is in contact with a corresponding photosensitive drum and a separated position at which the developing roller is separated from the corresponding photosensitive drum, wherein in response to the image forming apparatus being turned on or in response to the cover being moved from the open position to the closed position, the controller executes an initial separation process of moving the developing roller of each of the plurality of cartridges to separated position before executing the determination process.

4. The image forming apparatus of claim 3, further comprising a driving force transmission mechanism configured to transmit driving force of the first motor to the separation mechanisms, wherein the developing rollers are driven by the first motor, and wherein the driving force transmission mechanism is configured to transmit the driving force to the agitators, the developing rollers and the separation mechanisms when the first motor rotates in a first direction, and to transmit the driving force to the separation mechanism without transmitting the driving force to the agitators and the developing rollers when the first motor rotates in a second direction opposite to the first direction, and wherein the controller rotates the first motor in the second direction in the initial separation process.

5. The image forming apparatus of claim 3, further comprising a second motor configured to rotate the photosensitive drums, wherein the controller executes the initial stirring process by rotating the first motor in a state in which the second motor is stopped.

6. The image forming apparatus of claim 3, further comprising:

a fuser including a rotating body configured to fix a toner image formed on a sheet; and a third motor configured to rotate the rotating body, wherein the controller executes the initial stirring process by rotating the first motor in a state in which the third motor is stopped.

7. The image forming apparatus of claim 3, further comprising:

a belt disposed to face the photosensitive drums;

a fuser including a rotating body configured to fix a toner image formed on a sheet;

a second motor configured to rotate the photosensitive drums and the belt; and a third motor configured to rotate the rotating body, wherein the controller executes the initial stirring process by rotating the first motor in a state in which the second motor and the third motor are stopped.

8. The image forming apparatus of claim 7, wherein the controller executes the initial separating process by rotating the first motor in a state in which the second motor and the third motor are stopped.

9. A method of controlling an image forming apparatus comprising:

a housing having an opening;

a cover movable between a closed position for closing the opening and an open position for opening the opening; a plurality of photosensitive drums; and a plurality of cartridges each having a developing roller, a storage chamber configured to store toner, and an agitator configured to agitate the toner, the plurality of cartridges being configured to be mounted to the housing through the opening, the method including:

rotating the agitators at a first speed when forming an image on a sheet; and in response to the image forming apparatus being turned on or in response to the cover being moved from the open position to the closed position:

executing a determination process of determining whether a new cartridge is included in the plurality of cartridges;

executing an initial stirring process of stirring toner by rotating the agitator in a case where a new cartridge is included;

executing the initial stirring process by rotating the agitator at a second speed slower than the first speed; and not executing the initial stirring process in a case where a new cartridge is not included.

10. The method of claim 9, wherein the image forming apparatus further includes:

a belt disposed to face the photosensitive drums; and a fuser having a rotating body that fixes a toner image formed on a sheet, wherein when forming an image on a sheet, the photosensitive drums, the belt and the agitators are rotated, and wherein when executing the initial stirring process, the agitators are rotated without rotating the photosensitive drum and the belt.

11. An image forming apparatus comprising:

a housing having an opening;

a cover movable between a closed position for closing the opening and an open position for opening the opening;

a plurality of photosensitive drums;

a plurality of cartridges each having a developing roller, a storage chamber configured to store toner, and an agitator configured to agitate the toner, the plurality of cartridges being configured to be mounted to the housing through the opening;

a first motor configured to rotate the agitators;

a second motor configured to rotate the photosensitive drums, a plurality of separation mechanisms configured to move the developing rollers, respectively, each separation mechanism being configured to move a corresponding developing roller between a contact position at which the developing roller is in contact with a corresponding photosensitive drum and a separated position at which the developing roller is separated from the corresponding photosensitive drum; and a controller configured to, in response to the image forming apparatus being turned on or in response to the cover being moved from the open position to the closed position:

execute an initial separation process of rotating the first motor to move the developing roller of each of the plurality of cartridges to the separated position;

execute a determination process of determining whether a new cartridge is included in the plurality of cartridges after executing the initial separation process;

execute an initial stirring process of stirring toner with the agitators by rotating the first motor in a case where a new cartridge is included;

execute the initial stirring process by rotating the first motor in a state in which the second motor is stopped; and not execute the initial stirring process in a case where a new cartridge is not included.

12. The image forming apparatus of claim 11, wherein each of the plurality of cartridges has a memory storing identification data indicating whether the cartridge is new, and wherein the controller executes the determination process by reading the identification data from the memories.

13. The image forming apparatus of claim 11, further comprising a driving force transmission mechanism configured to transmit driving force of the first motor to the separation mechanisms, wherein the developing rollers are driven by the first motor, and wherein the driving force transmission mechanism is configured to transmit the driving force to the agitators, the developing rollers and the separation mechanisms when the first motor rotates in a first direction, and to transmit the driving force to the separation mechanism without transmitting the driving force to the agitators and the developing rollers when the first motor rotates in a second direction opposite to the first direction, and wherein the controller rotates the first motor in the second direction in the initial separation process.

14. The image forming apparatus of claim 11, further comprising:

a fuser including a rotating body configured to fix a toner image formed on a sheet; and a third motor configured to rotate the rotating body, wherein the controller executes the initial stirring process by rotating the first motor in a state in which the third motor is stopped.

15. The image forming apparatus of claim 11, further comprising:

a belt disposed to face the photosensitive drums;

a fuser including a rotating body configured to fix a toner image formed on a sheet;

a second motor configured to rotate the photosensitive drums and the belt; and a third motor configured to rotate the rotating body, wherein the controller executes the initial stirring process by rotating the first motor in a state in which the second motor and the third motor are stopped.

16. An image forming apparatus comprising:

a housing having an opening;

a cover movable between a closed position for closing the opening and an open position for opening the opening;

a plurality of photosensitive drums;

a plurality of cartridges each having a developing roller, a storage chamber configured to store toner, and an agitator configured to agitate the toner, the plurality of cartridges being configured to be mounted to the housing through the opening;

a first motor configured to rotate the agitators;

a second motor configured to rotate the photosensitive drums;

a plurality of separation mechanisms configured to move the developing rollers, respectively, each separation mechanism being configured to move a corresponding developing roller between a contact position at which the developing roller is in contact with a corresponding photosensitive drum and a separated position at which the developing roller is separated from the corresponding photosensitive drum;

a fuser including a rotating body configured to fix a toner image formed on a sheet;

a third motor configured to rotate the rotating body, and a controller configured to, in response to the image forming apparatus being turned on or in response to the cover being moved from the open position to the closed position:

execute an initial separation process of rotating the first motor to move the developing roller of each of the plurality of cartridges to the separated position;

execute a determination process of determining whether a new cartridge is included in the plurality of cartridges after executing the initial separation process;

execute an initial stirring process of stirring toner with the agitators by rotating the first motor in a case where a new cartridge is included;

execute the initial stirring process by rotating the first motor in a state in which the third motor is stopped; and not execute the initial stirring process in a case where a new cartridge is not included.

* * * * *